US008806676B2

(12) United States Patent
Reeb et al.

(10) Patent No.: US 8,806,676 B2
(45) Date of Patent: Aug. 19, 2014

(54) PORTABLE HAMMOCK AND HAMMOCK FRAME

(75) Inventors: David L. Reeb, Columbia, MD (US); Walter Paul Robinette, Canal Winchester, OH (US)

(73) Assignee: Swimways Corporation, Virginia Beach, VA (US)

( * ) Notice: Subject to any disclaimer, the term of this patent is extended or adjusted under 35 U.S.C. 154(b) by 270 days.

(21) Appl. No.: 12/776,955

(22) Filed: May 10, 2010

(65) Prior Publication Data

US 2010/0287700 A1 Nov. 18, 2010

Related U.S. Application Data

(60) Provisional application No. 61/177,062, filed on May 11, 2009.

(51) Int. Cl.
*A45F 3/22* (2006.01)

(52) U.S. Cl.
USPC ..... 5/120; 5/122; 5/127; 5/129

(58) Field of Classification Search
USPC ..... 5/110, 111, 120, 127, 129, 122–124; 297/19, 29, 273, 277, 279, 440.11, 297/440.12, 452.13
See application file for complete search history.

(56) References Cited

U.S. PATENT DOCUMENTS

| | | | |
|---|---|---|---|
| 7,712 | A | 10/1850 | Whitmarsh |
| 221,754 | A | 11/1879 | Travers |
| 314,986 | A | 4/1885 | Aenis |
| 342,668 | A | 5/1886 | Woodbury |
| 369,546 | A | 9/1887 | Nickerson |
| 381,025 | A | 4/1888 | Parmelee |
| 398,943 | A | 3/1889 | Crandall |
| 416,242 | A | 12/1889 | Sutphen |
| 468,576 | A | 2/1892 | Palmer |
| 469,869 | A | 3/1892 | Palmer |

(Continued)

FOREIGN PATENT DOCUMENTS

| | | |
|---|---|---|
| DE | 1 958 083 | 7/1970 |
| DE | 28 53 993 A1 | 7/1980 |

(Continued)

OTHER PUBLICATIONS

Advertisement for the "Easy Foldable Hammock," 1 page.

(Continued)

*Primary Examiner* — Nicholas Polito
(74) *Attorney, Agent, or Firm* — Cooley LLP

(57) ABSTRACT

In one embodiment, a frame has a first expanded configuration, a second expanded configuration and a collapsed configuration. The frame includes a support member, a first elongate member, a second elongate member and a coupling member. A first end portion of the first elongate member is pivotally coupled to the support member. A first end portion of the second elongate member is pivotally coupled to the support member. The coupling member is coupled to a second end portion of the second elongate member. A second end portion of the first elongate member is coupled to the coupling at a first location of the coupling member when the frame is in its first expanded configuration. The second end portion of the first elongate member is coupled to the coupling member at a second location of the coupling member when the frame is in its second expanded configuration.

26 Claims, 19 Drawing Sheets

(56) References Cited

U.S. PATENT DOCUMENTS

| | | | | | |
|---|---|---|---|---|---|
| 506,776 | A | * | 10/1893 | Ford | 5/129 |
| 531,727 | A | | 1/1895 | Keegan, Sr. et al. | |
| 540,041 | A | | 5/1895 | Blomberg | |
| 604,942 | A | | 5/1898 | Palmer | |
| 631,747 | A | | 8/1899 | Lloyd | |
| 699,410 | A | | 5/1902 | Palmer | |
| 717,119 | A | | 12/1902 | Potter | |
| 817,534 | A | | 4/1906 | Troselj | |
| 862,346 | A | | 8/1907 | Pihlblad et al. | |
| 904,006 | A | | 11/1908 | Oberg | |
| 998,761 | A | | 7/1911 | Engstrand | |
| 1,097,100 | A | | 5/1914 | Kallio | |
| 1,120,234 | A | | 12/1914 | Palmer | |
| 1,151,495 | A | | 8/1915 | Menten | |
| 1,176,963 | A | | 3/1916 | Howell | |
| 1,185,568 | A | | 5/1916 | Zeunert | |
| 1,224,782 | A | | 5/1917 | Pedersen | |
| 1,312,299 | A | | 8/1919 | Almen | |
| 1,367,955 | A | | 2/1921 | Finstrom | |
| 1,480,591 | A | | 1/1924 | Bakesef et al. | |
| 1,543,814 | A | * | 6/1925 | Banning | 5/122 |
| 1,567,418 | A | * | 12/1925 | Carnes | 297/8 |
| 1,693,564 | A | | 11/1928 | Murphy et al. | |
| 1,732,008 | A | | 10/1929 | Frantz | |
| 1,758,721 | A | | 5/1930 | Swartz et al. | |
| 1,788,919 | A | | 1/1931 | Lansberry et al. | |
| 1,917,518 | A | | 7/1933 | Goudie | |
| 2,503,508 | A | | 4/1950 | Parks | |
| 2,581,623 | A | | 1/1952 | Benjamin | |
| 3,086,740 | A | | 4/1963 | Hatton | |
| 3,593,352 | A | | 7/1971 | Britt | |
| 4,062,586 | A | * | 12/1977 | Ortize | 297/248 |
| 4,221,429 | A | * | 9/1980 | Wade | 297/277 |
| 4,229,845 | A | | 10/1980 | de Cuadros | |
| 4,384,379 | A | | 5/1983 | Yamada | |
| D274,390 | S | | 6/1984 | Shakas | |
| 4,691,394 | A | | 9/1987 | Woo | |
| D295,242 | S | | 4/1988 | Frick et al. | |
| 4,757,563 | A | | 7/1988 | An | |
| 4,826,241 | A | | 5/1989 | Barras | |
| 4,925,138 | A | | 5/1990 | Rawlins | |
| 4,951,332 | A | | 8/1990 | Barmettler | |
| 5,003,652 | A | | 4/1991 | Bayless | |
| 5,046,203 | A | | 9/1991 | de Cuadros | |
| D342,841 | S | | 1/1994 | Campanello | |
| 5,392,476 | A | * | 2/1995 | Williams | 5/127 |
| 5,414,873 | A | * | 5/1995 | Wolf | 5/122 |
| 5,636,392 | A | | 6/1997 | Choi | |
| 5,655,235 | A | | 8/1997 | DeAth | |
| 5,659,907 | A | | 8/1997 | Huang | |
| 5,715,552 | A | | 2/1998 | DeAth | |
| 5,718,473 | A | | 2/1998 | Lynch, Jr. | |
| 5,740,570 | A | | 4/1998 | Hsieh | |
| D408,166 | S | | 4/1999 | Bayless | |
| D411,387 | S | | 6/1999 | Zheng | |
| 5,913,772 | A | | 6/1999 | Clark | |
| 5,983,422 | A | | 11/1999 | Bayless | |
| 5,984,406 | A | | 11/1999 | Lee | |
| 6,003,173 | A | | 12/1999 | Meoli et al. | |
| D425,722 | S | | 5/2000 | Hennessy | |
| 6,082,813 | A | | 7/2000 | Chen | |
| 6,112,757 | A | | 9/2000 | Tseng | |
| 6,134,727 | A | | 10/2000 | Hwang | |
| 6,170,907 | B1 | | 1/2001 | Tsai | |
| 6,179,374 | B1 | | 1/2001 | Tang | |
| 6,276,008 | B1 | | 8/2001 | Chen | |
| 6,314,594 | B1 | | 11/2001 | Meoli et al. | |
| 6,364,410 | B1 | | 4/2002 | Tang | |
| 6,402,230 | B1 | | 6/2002 | Tang | |
| 6,418,577 | B1 | | 7/2002 | Murphy | |
| 6,446,282 | B1 | | 9/2002 | Wu | |
| 6,454,348 | B1 | | 9/2002 | Wu | |
| 6,457,192 | B2 | | 10/2002 | Choi et al. | |
| 6,467,109 | B1 | * | 10/2002 | Wu | 5/120 |
| 6,470,518 | B1 | | 10/2002 | Ke | |
| 6,564,402 | B1 | | 5/2003 | Lin | |
| 6,629,722 | B1 | | 10/2003 | Tang | |
| 6,711,761 | B2 | | 3/2004 | Choi | |
| 6,763,534 | B2 | | 7/2004 | Hwang | |
| D498,088 | S | | 11/2004 | Tsang | |
| 6,925,664 | B1 | | 8/2005 | Twigg | |
| 6,931,679 | B1 | | 8/2005 | Tseng | |
| 6,957,453 | B2 | * | 10/2005 | Branch, III | 5/123 |
| 6,966,084 | B2 | | 11/2005 | Le Gette et al. | |
| 7,089,610 | B2 | | 8/2006 | Zhong | |
| 7,114,205 | B2 | | 10/2006 | Choi | |
| 7,272,865 | B2 | | 9/2007 | Le Gette et al. | |
| 7,334,837 | B1 | | 2/2008 | Long | |
| 7,395,561 | B2 | | 7/2008 | Le Gette et al. | |
| 7,406,726 | B2 | | 8/2008 | Deng | |
| 7,441,287 | B2 | | 10/2008 | Zheng | |
| 7,509,695 | B2 | | 3/2009 | Zheng | |
| 7,571,499 | B2 | | 8/2009 | Le Gette et al. | |
| 7,926,129 | B2 | | 4/2011 | Reeb et al. | |
| 8,214,946 | B2 | | 7/2012 | Reeb et al. | |
| 2001/0054198 | A1 | | 12/2001 | Choi et al. | |
| 2004/0000009 | A1 | | 1/2004 | Choi | |
| 2004/0034929 | A1 | | 2/2004 | Hwang | |
| 2004/0206861 | A1 | | 10/2004 | Le Gette et al. | |
| 2005/0060802 | A1 | | 3/2005 | Zhong | |
| 2005/0188460 | A1 | | 9/2005 | O'Brien | |
| 2005/0246836 | A1 | | 11/2005 | Wu | |
| 2006/0070180 | A1 | | 4/2006 | Le Gette et al. | |
| 2006/0150325 | A1 | | 7/2006 | Zheng | |
| 2006/0282948 | A1 | | 12/2006 | Deng | |
| 2007/0209113 | A1 | | 9/2007 | Le Gette et al. | |
| 2008/0256703 | A1 | | 10/2008 | Le Gette et al. | |
| 2009/0038071 | A1 | * | 2/2009 | Bass et al. | 5/120 |
| 2009/0064415 | A1 | | 3/2009 | Payne et al. | |
| 2010/0024124 | A1 | | 2/2010 | Reeb et al. | |

FOREIGN PATENT DOCUMENTS

| | | |
|---|---|---|
| DE | 201 10 262 UI | 9/2001 |
| IT | 697011 | 11/1972 |
| WO | WO 86/05081 | 9/1986 |

OTHER PUBLICATIONS

Advertisement for the "Folding Hammock-Padded Reversible" and the "Heavenly Slumber Hammock," 1 page.
Advertisement for the "Hide-Away Hammock", 1 page.
International Search Report for PCT Application No. PCT/US04/11852 mailed on Nov. 29, 2006, 4 pages.

* cited by examiner

PORTABLE HAMMOCK AND HAMMOCK FRAME

CROSS REFERENCE TO RELATED APPLICATION

This application claims priority to and the benefit of U.S. Provisional Patent Application No. 61/177,062, filed May 11, 2009, entitled "Portable Hammock and Hammock Frame," the entire disclosure of which is incorporated herein by reference.

BACKGROUND

This invention relates generally to a support having multiple configurations, and in particular, to a support, such as a hammock support, that can be disposed in multiple expanded configurations and in a collapsed configuration. The hammock support includes a hammock membrane.

Known hammocks and hammock supports can be used to support a user. Such hammocks and hammock supports are often transported and used in various outdoor settings, such as in a backyard or at a campground. Known hammocks, however, disadvantageously only have a single expanded configuration. Thus, the hammocks have limited functions.

Known hammocks and hammock supports have a hammock member (e.g., a membrane) to contact and support a user. Such hammock members, however, disadvantageously define only a single distinct receiving portion.

A need, therefore, exists for a hammock and hammock support that can be easily converted between a first expanded configuration, a second expanded configuration and a collapsed configuration. A need also exists for a hammock member defining multiple distinct receiving portions.

SUMMARY OF THE INVENTION

In one embodiment, a frame has a first expanded configuration, a second expanded configuration and a collapsed configuration. The frame includes a support member, a first elongate member, a second elongate member and a coupling member. The first elongate member has a first end portion and a second end portion opposite the first end portion. The first end portion of the first elongate member is pivotally coupled to the support member. The second elongate member has a first end portion and a second end portion opposite the first end portion. The first end portion of the second elongate member is pivotally coupled to the support member. The coupling member is coupled to the second end portion of the second elongate member. The coupling member has a first location and a second location different from the first location. The second end portion of the first elongate member is coupled to the coupling at the first location of the coupling member when the frame is in its first expanded configuration. The second end portion of the first elongate member is coupled to the coupling member at the second location of the coupling member when the frame is in its second expanded configuration, the second end portion of the first elongate member is separated from the coupling member when the frame is in the collapsed configuration.

In another embodiment, a hammock membrane has a first end portion and a second end portion opposite the first end portion. The hammock membrane has a middle portion disposed between the first end portion and the second end portion. The first end portion defines a pocket configured to receive a torso portion of a user. The second end portion defines a pocket configured to receive a lower portion of the user. The pocket defined by the first end portion being separate from the pocket defined by the second end portion.

In yet another embodiment, a frame has a first expanded configuration, a second expanded configuration and a collapsed configuration. The frame has a first end portion and a second end portion opposite the first end portion. A hammock member has a first end portion and a second end portion opposite the first end portion. The first end portion of the hammock member is removably coupled to the first end portion of the frame. The second end portion of the hammock member is removably coupled to the second end portion of the frame. The first end portion of the hammock member is separated from the support surface by a first distance orthogonal to the support surface when the frame is in its first expanded configuration and the frame is disposed on the support surface. The first end portion of the hammock member is separated from the support surface by a second distance orthogonal to the support surface when the frame is in its second expanded configuration and the frame is disposed on the support surface. The first distance is less than the second distance. The second end portion of the hammock member is separated from the support surface by a third distance orthogonal to the support surface when the frame is in its first expanded configuration and the frame is disposed on the support surface. The second end portion of the hammock member is separated from the support surface by a fourth distance orthogonal to the support surface when the frame is in its second expanded configuration and the frame is disposed on the support surface. The fourth distance is less than the third distance.

In still yet another embodiment, a hammock membrane has a first end portion and a second end portion opposite the first end portion. The hammock membrane has a middle portion between the first end portion and the second end portion. The hammock membrane has a first side portion and a second side portion opposite the first side portion. A first elongate member has a first end portion and a second end portion opposite the first end portion. The first end portion of the first elongate member is coupled to the first end portion of the hammock membrane along the first side portion of the hammock membrane. The second end portion of the first elongate member is coupled to the first end portion of the hammock membrane along the second side portion of the hammock membrane. A second elongate member has a first end portion and a second end portion opposite the first end portion. The first end portion of the second elongate member is coupled to the second end portion of the hammock membrane along the first side portion of the hammock membrane. The second end portion of the second elongate member is coupled to the second end portion of the hammock membrane along the second side portion of the hammock membrane. A third elongate member has a first end portion and a second end portion opposite the first end portion. The first end portion of the third elongate member is coupled to the middle portion of the hammock membrane along the first side portion of the hammock membrane. The second end portion of the third elongate member is coupled to the middle portion of the hammock membrane along the second side portion of the hammock membrane.

DETAILED DESCRIPTION

A support device includes a frame that can be disposed in multiple expanded configurations and in a collapsed configuration. The frame is self-supporting when disposed in one of its expanded configuration. An end portion of the frame and the middle portion of the frame collectively form a first angle when the frame is in a first expanded configuration. The end portion of the frame and the middle portion of the frame collectively form a second angle different from the first angle when the frame is in a second expanded configuration. The frame is compact and easily transportable when disposed in its collapsed configuration. The support device includes a hammock member defining multiple pockets. The support device described herein can be placed on a support surface, such as, for example a floor. The support device is configured to support a user when the frame is in its expanded configurations.

Figure 1:
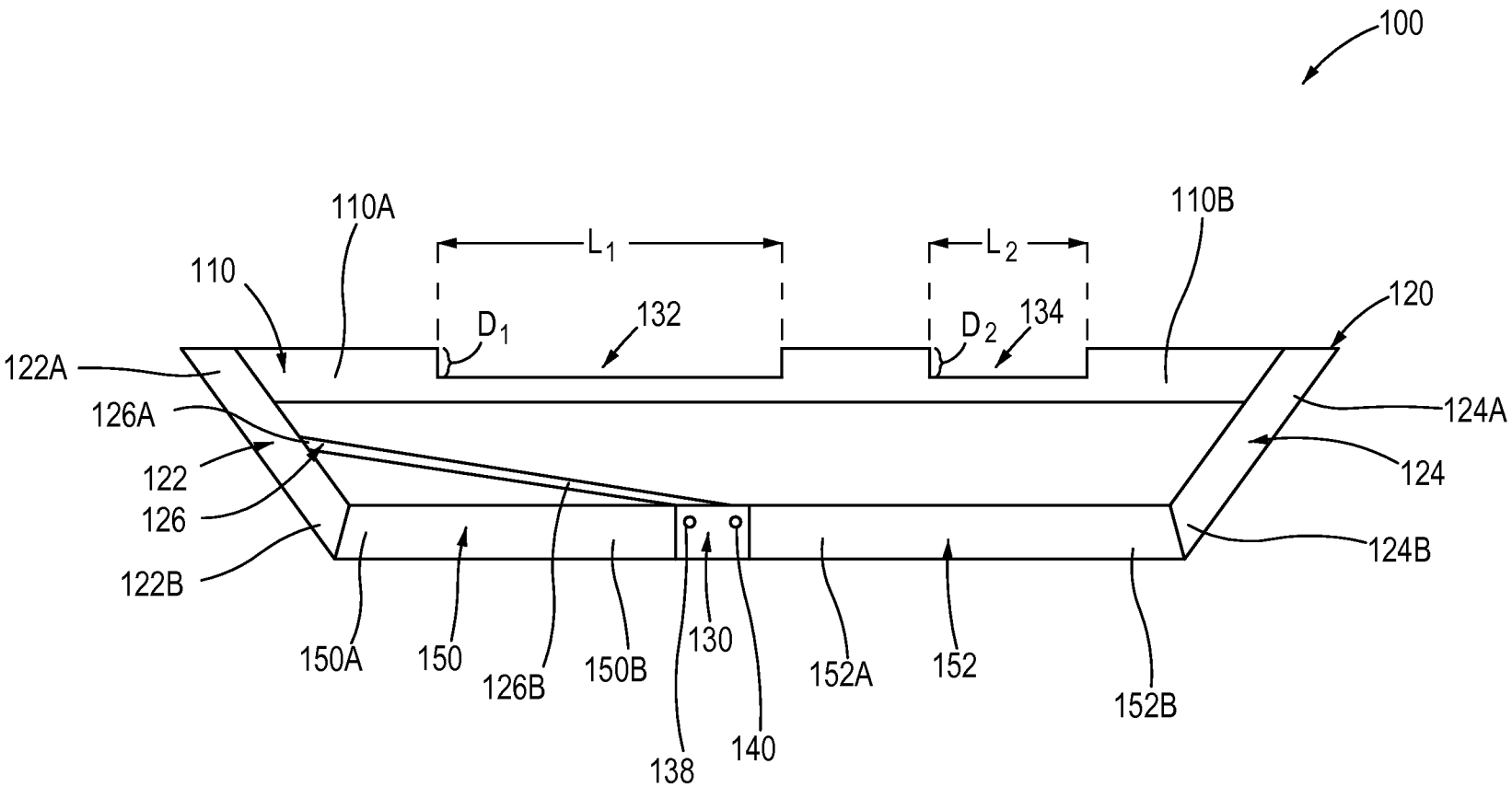
FIG. 1 is a schematic illustration of a support according to an embodiment.

FIG. 1 is a schematic illustration of a support device according to an embodiment. As shown in FIG. 1, an apparatus 100 (also referred herein as a "support") includes a hammock member 110 and a frame 120.

The frame 120 includes a first support member 122, a second support member 124, a first connection member 126, a second connection member 150, a third connection member 152 and a coupling member 130. The first support member 122 has a first end portion 122A and a second end portion 122B opposite the first end portion 122A. The second support member 124 has a first end portion 124A and a second end portion 124B opposite the first end portion 124A. The first connection member 126 has a first end portion 126A and a second end portion 126B opposite the first end portion 126A. The second connection member 150 has a first end portion 150A and a second end portion 150B opposite the first end portion 150A. The third connection member 152 has a first end portion 152A and a second end portion 152B opposite the first end portion 152A. The first end portion 126A of the first connection member 126 is pivotally coupled to the first support member 122. The second end portion 126B of the first connection member 126 is configured to be coupled to the coupling member 130. The first end portion 150A of the second connection member 150 is pivotally coupled to the second end portion 122B of the first support member 122. The second end portion 150B of the second connection member 150 is coupled to the coupling member 130. The first end portion 152A of the third connection member 152 is coupled to the coupling member 130. The second end portion 152B of the third connection member 152 is pivotally coupled to the second end portion 124B of the second support member 124.

The hammock member 110 is removably coupled to the frame 120. Specifically, a first end portion 110A of the hammock member 110 is removably coupled to the first end portion 122A of the first support member 122 of the frame 120. A second end portion 110B of the hammock member 110 is removably coupled to the first end portion 124A of the second support member 124 of the frame 120.

The first end portion 110A of the hammock member 110 defines a first pocket 132 having a length L1 and a depth D1 (i.e., height). The second end portion 110B of the hammock member 110 defines a second pocket 134 having a length L2 and a depth D2 (i.e., height). The second pocket 134 is separate from (e.g., distinct, mutually exclusive) the first pocket 132. The length L1 of the first pocket 132 is different than the length L2 of the second pocket 134. The depth D1 of the first pocket 132 is different than the depth D2 of the second pocket 134. In some embodiments, the depth D1 of the first pocket 132 varies along the length L1 of the first pocket 132. Accordingly, in some embodiments, the depth D1 of the first pocket 132 is a first depth of the first pocket 132 at a first location of the first pocket 132. The first end portion 110A of the hammock member 110 defines the first pocket 132 such that the first pocket 132 also has a second depth at a second location different from the first location. The first depth at the first location being less than the second depth at the second location. Said differently, a first portion of the first pocket has a first height at a first location and a second portion of the first pocket has a second height at a second location different than the first location. The first height at the first location is different from the second height at the second location. Similarly, in some embodiments, the depth D2 of the second pocket 134 varies along the length L2 of the second pocket 134. Accordingly, the depth D2 of the second pocket 134 is a first depth of the second pocket 134. The second end portion 110B of the hammock member 110 defines the second pocket 134 such that second pocket 134 also has a second depth different from the first depth. In other words, a first portion of the second pocket has a first height and a second portion of the second pocket has a second height different from the first height. In some embodiments, the first pocket and/or the second pocket are tapered. Specifically, the depth of the first pocket increases along the length of the first pocket. Similarly, the depth of the second pocket increases along the length of the second pocket.

The region defining the first pocket 132 includes more fabric at the center of the region than at the edges of the region, allowing the region to have a wedge-like form to receive the torso of a user. Similarly, the region defining the second pocket 134 includes more fabric at the center of the region than at the edges of the region, allowing the region to have a wedge-like form to receive a lower portion of the user.

In some embodiments, a cross member has a first end portion and a second end portion opposite the first end portion. The cross member can be coupled to the hammock member between the first pocket and the second pocket. Specifically, the first end portion of the cross member can be coupled to a first side portion of the hammock member and the second end portion of the cross member can be coupled to a second side portion of the hammock member such that the cross member is disposed between the first pocket and the second pocket.

The frame 120 has a first expanded configuration, a second expanded configuration and a collapsed configuration. The first expanded configuration is different from the second expanded configuration. The frame 120 has a shape similar to a "U" or a "V" when the frame 120 is in either its first or second expanded configuration and viewed from a side. The frame 120 can support the hammock member 110 and a user of the support 100 disposed on the hammock member 110 when the frame 120 is in either the first or second expanded configuration. In some embodiments, the first support member 122, the second support member 124, the first connection member 126, the second connection member 150 and the third connection member 152 can be substantially parallel to one another when the frame 120 is in the collapsed configuration.

The first end portion 110A of the hammock member 110 is substantially level with respect to a second end portion 110B of the hammock member 110 when the frame 120 is in its first expanded configuration. Accordingly, the support 100 is configured to support a user such that the user is substantially parallel to a support surface when the frame 120 is in its first expanded configuration (i.e., a reclined expanded configuration). In other words, the user can lay on the hammock member 110 when the frame 120 is in its first expanded configuration. The first end portion 110A of the hammock member 110 is elevated above the second end portion 110B of the hammock member 110 with respect to a support surface (not shown) when the frame 120 is in its second expanded configuration. Accordingly, the support 100 is configured to support the user such that the user is inclined with respect to the support surface when the frame 120 is in its second expanded configuration (i.e., an upright expanded configuration). Said differently, the user can sit on the hammock member 110 when the frame 120 is in its second expanded configuration.

The frame 120 is moveable between the first expanded configuration and the second expanded configuration. Specifically, the first connection member 126 can pivot with respect to the first support member 122. The second connection member 150 can pivot with respect to the first support member 122. The third connection member 152 can pivot or move with respect to the second support member 124.

The coupling member 130 has two locations 138 and 140 at which the second end portion 126B of the first connection member 126 can couple to the coupling member 130. The frame 120 is in its first expanded configuration when the first connection member 126 is coupled to the coupling member 130 at the first location 138. The frame 120 is in its second expanded configuration when the first connection member 126 is coupled to the coupling member 130 at the second location 140. Moving the second end portion 126B of the first connection member 126 from the first location 138 to the second location causes the first support member 122 to pivot or move with respect to the first connection member 126. Accordingly, the frame 120 is moved from its first expanded configuration to its second expanded configuration.

The first support member 122 and the second connection member 150 collectively form a first angle when the frame 120 is in its first expanded configuration. The first support member 122 and the second connection member 150 collectively form a second angle different from the first angle when the frame 120 is in its second expanded configuration. Similarly, in some embodiments, the frame 120 includes a fourth connection member having a first end portion and a second end portion opposite the first end portion. The second end portion of the fourth connection member is pivotally coupled to the second support member 124. The first end portion of the fourth connection member is configured to be coupled to the coupling member 130. The second support member 124 and the third connection member 152 collectively form a third angle when the frame 120 is in its first expanded configuration. The second support member 124 and the third connection member 152 collectively form a fourth angle different from the third angle when the frame 120 is in its second expanded configuration.

The frame 120 is moveable between its expanded configurations and its collapsed configuration. Specifically, moving the second end portion 126B of the first connection member 126 away from the coupling member 130 causes the frame 120 to move from one of its expanded configurations to its collapsed configuration. Similarly, moving the second end portion 126B of the first connection member 126 towards the coupling member 130 causes the frame 120 to move from its collapsed configuration to one of its expanded configurations.

Figure 2:
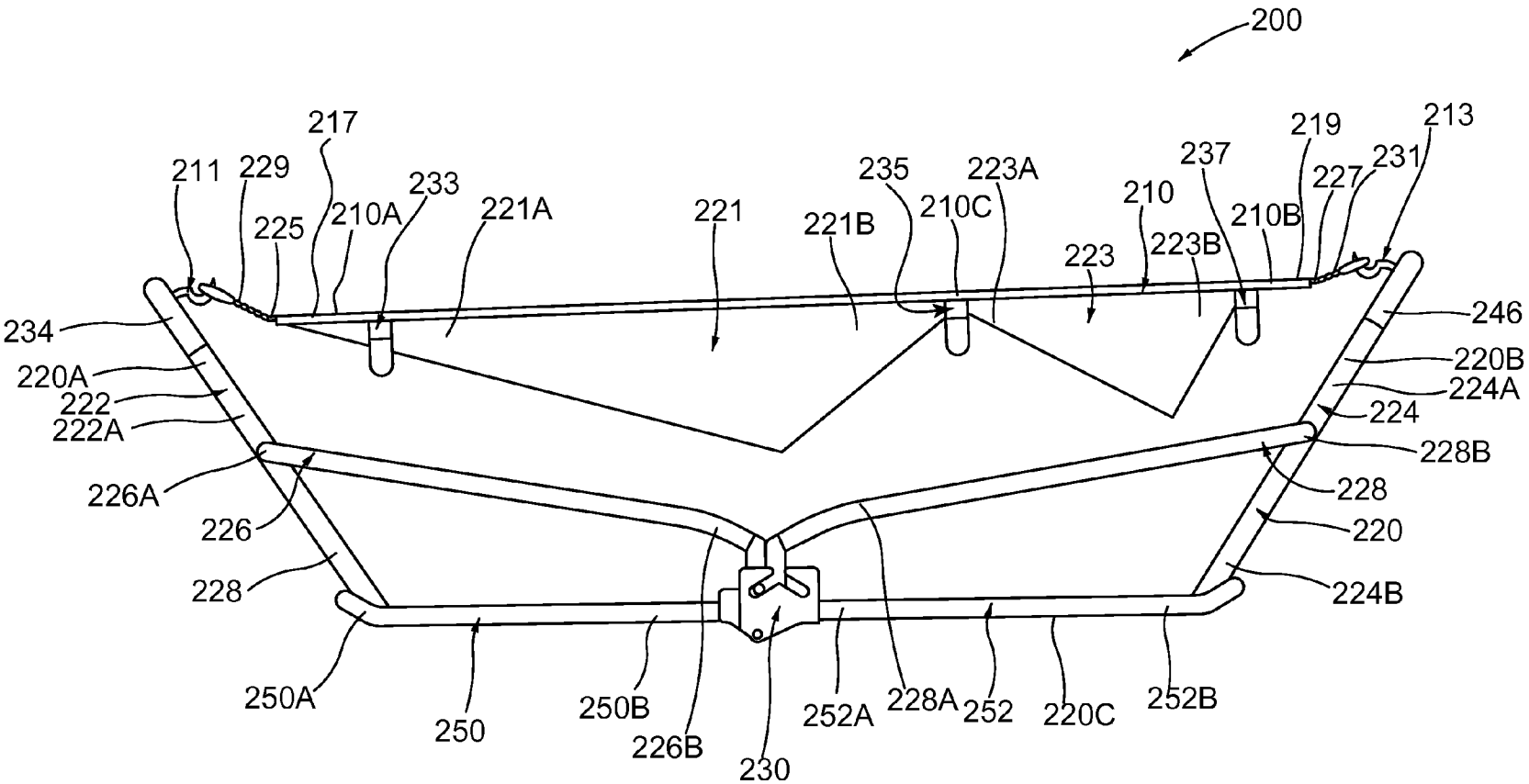
FIG. 2 is a side view of a support according to an embodiment.
Figure 3:
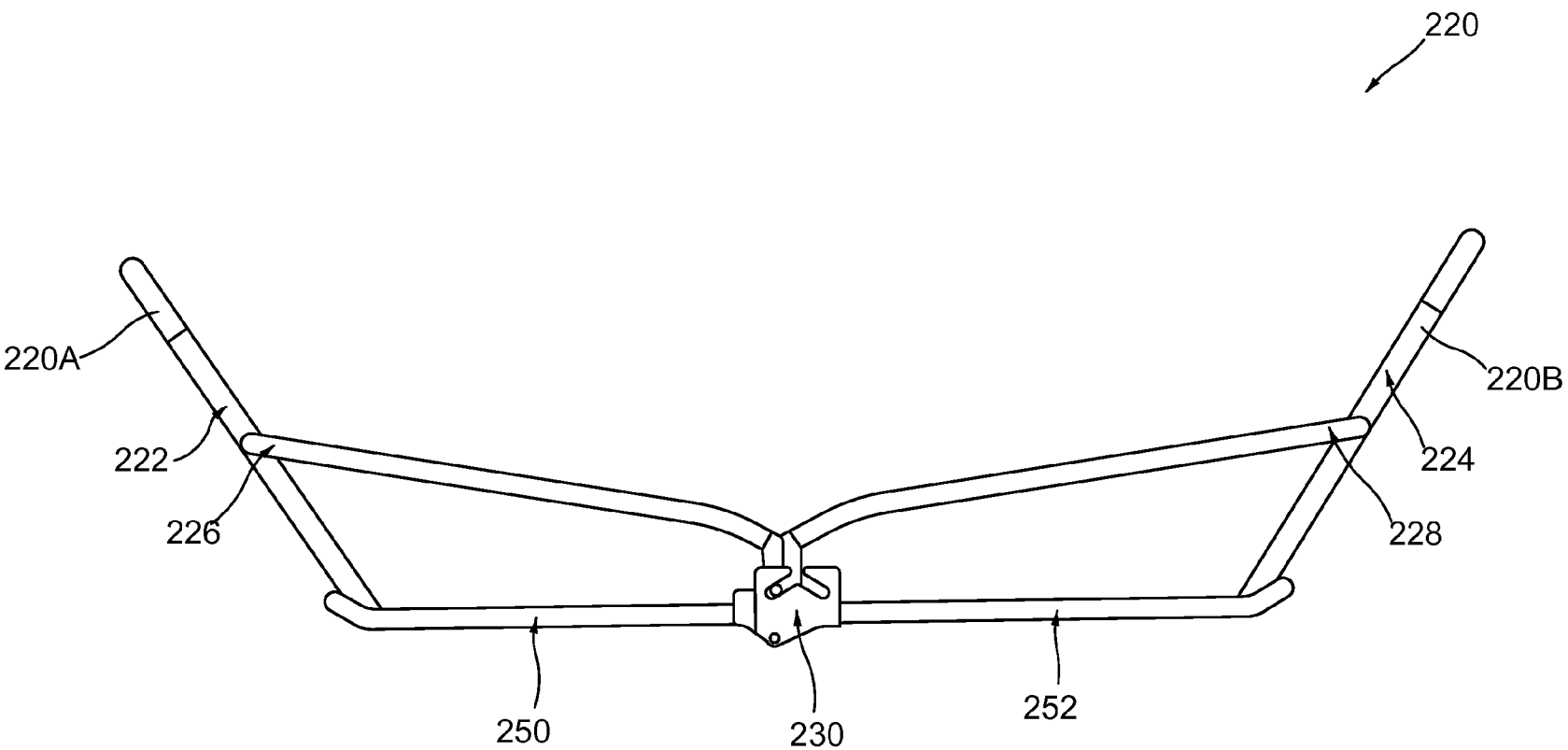
FIG. 3 is a side view of a frame of the support of FIG. 2 disposed in a first expanded configuration.
Figure 4:
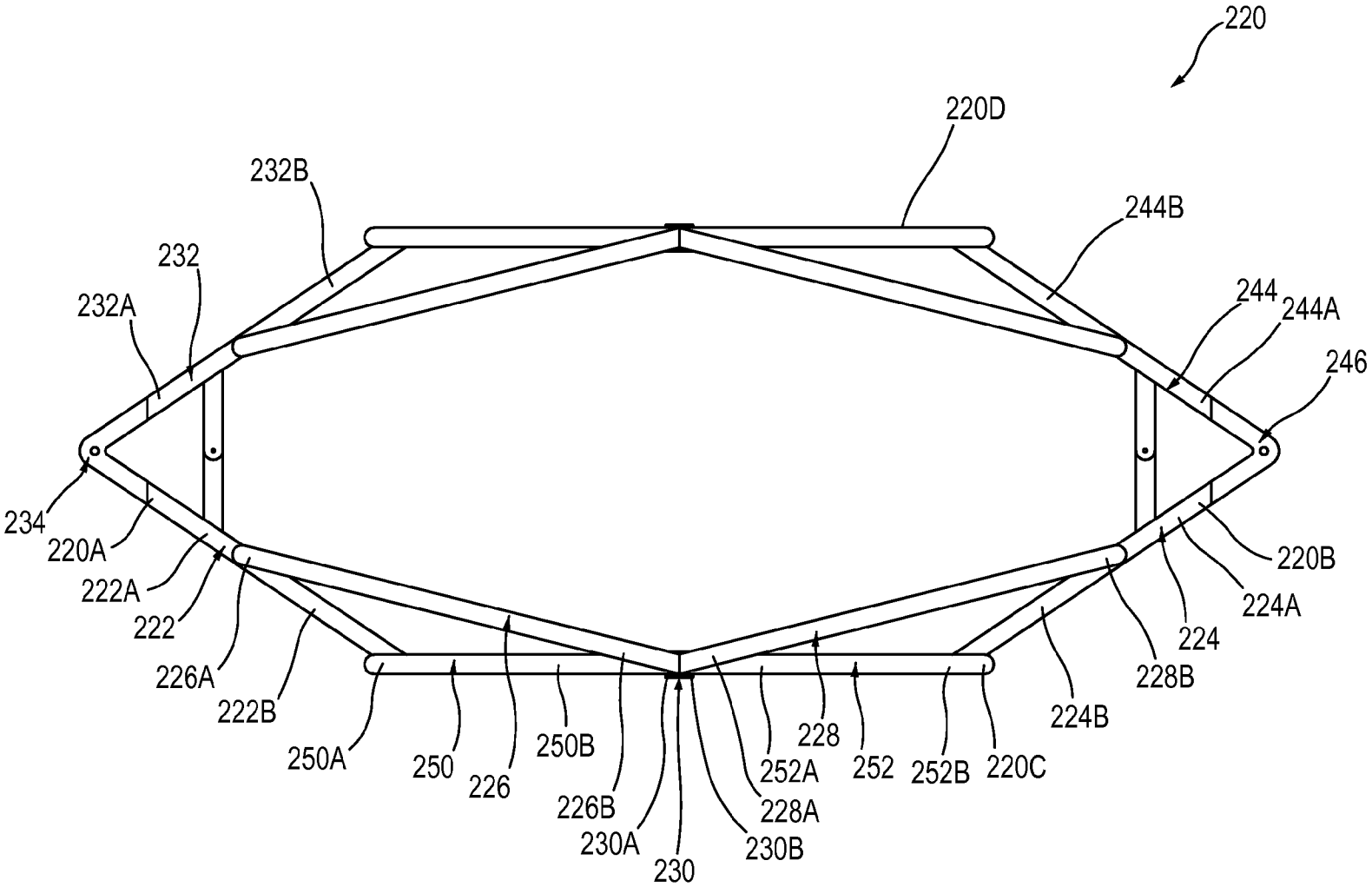
FIG. 4 is a top view of the frame of FIG. 3 disposed in the first expanded configuration.
Figure 4A:
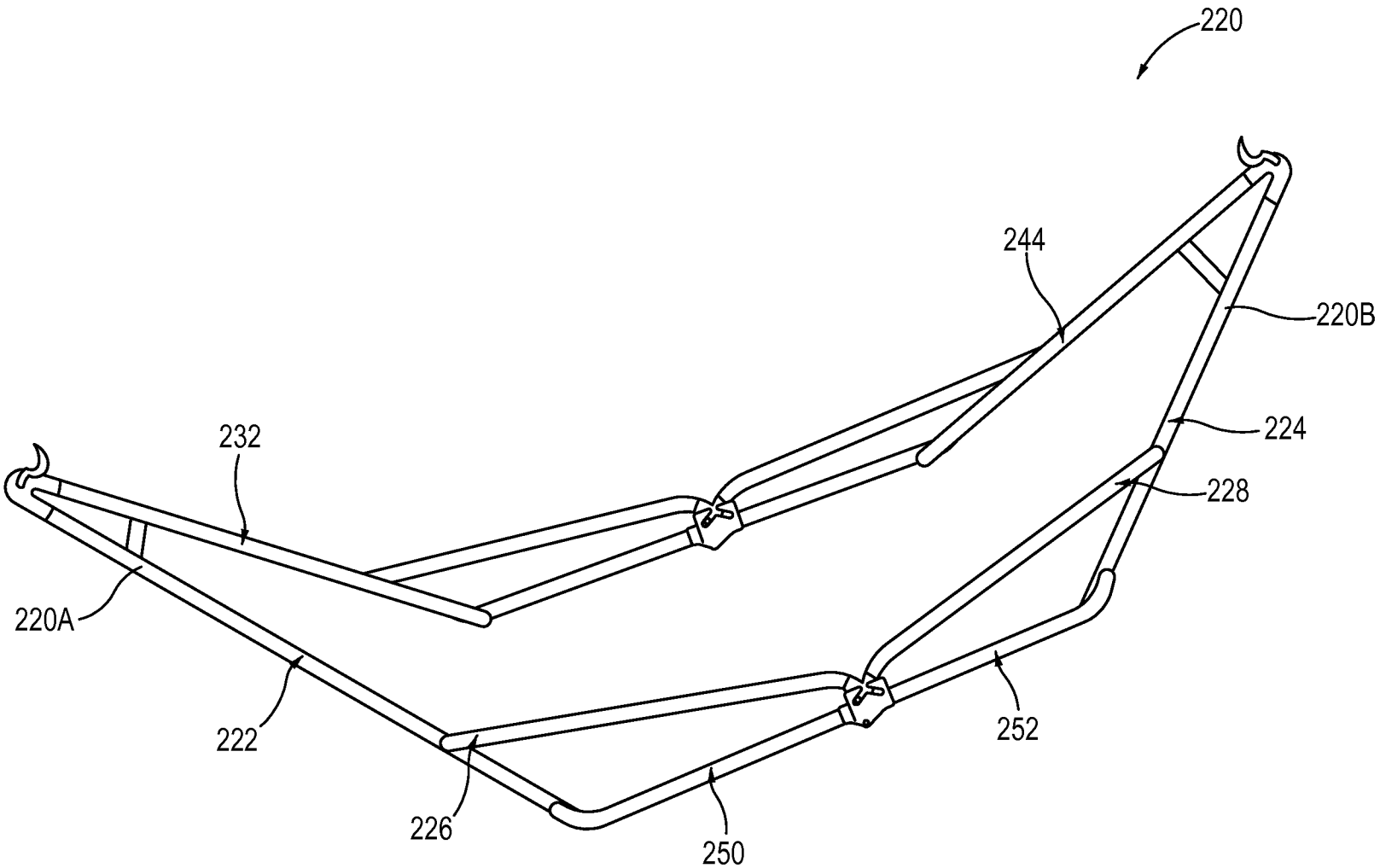
FIG. 4A is a perspective view of the frame of FIG. 3 disposed in the first expanded configuration.
Figure 5:
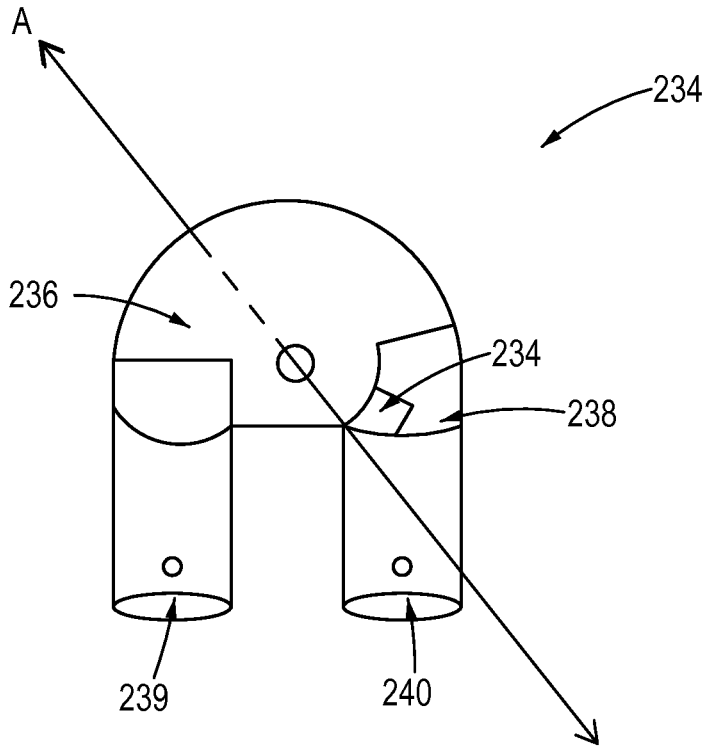
FIG. 5 is a side view of a coupler disposed in a closed configuration, according to an embodiment.
Figure 6:
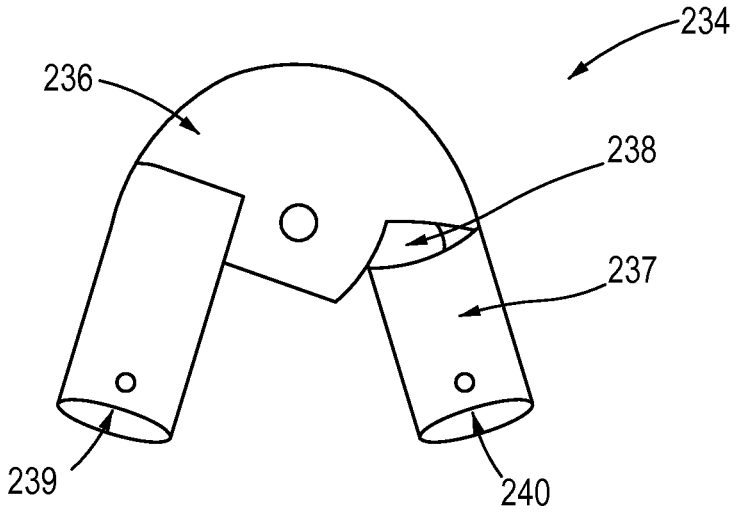
FIG. 6 is a side view of the coupler disposed in an open configuration, according to an embodiment.
Figure 7:
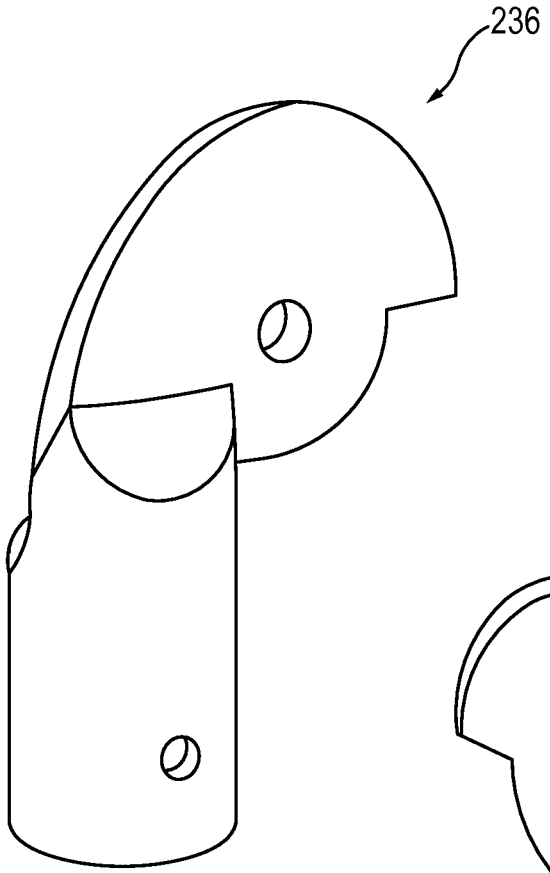
FIG. 7 is a side perspective view of a portion of the coupler of FIG. 5.
Figure 8:
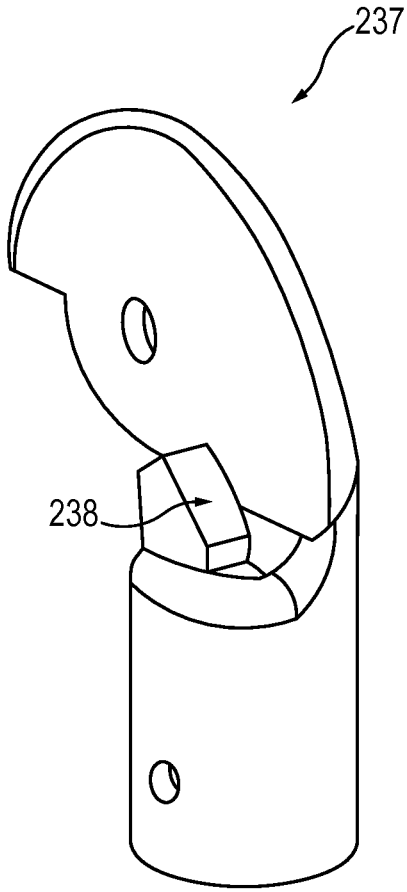
FIG. 8 is a side perspective view of another portion of the coupler of FIG. 5.
Figure 10:
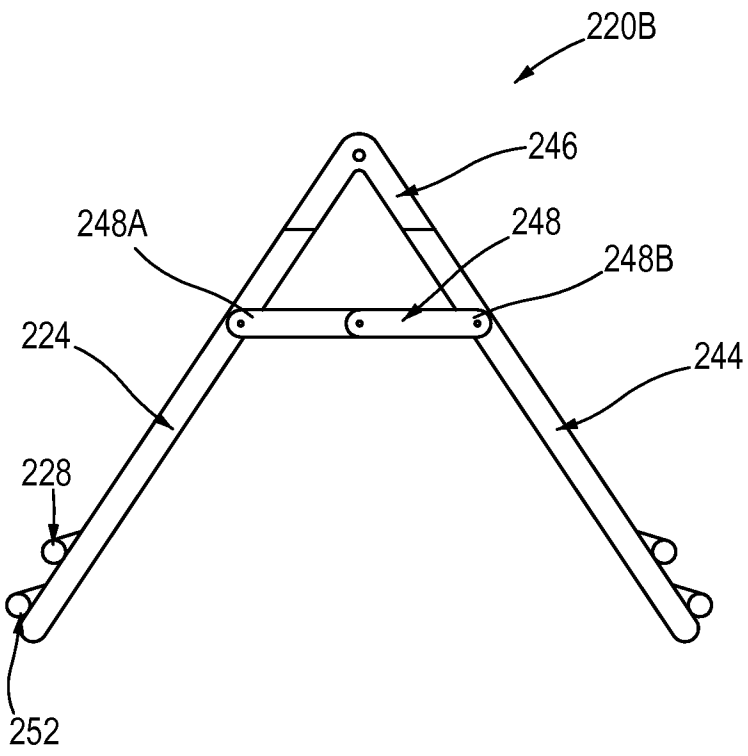
FIG. 10 is another end view of the frame of FIG. 3 disposed in an open configuration.
Figure 9:
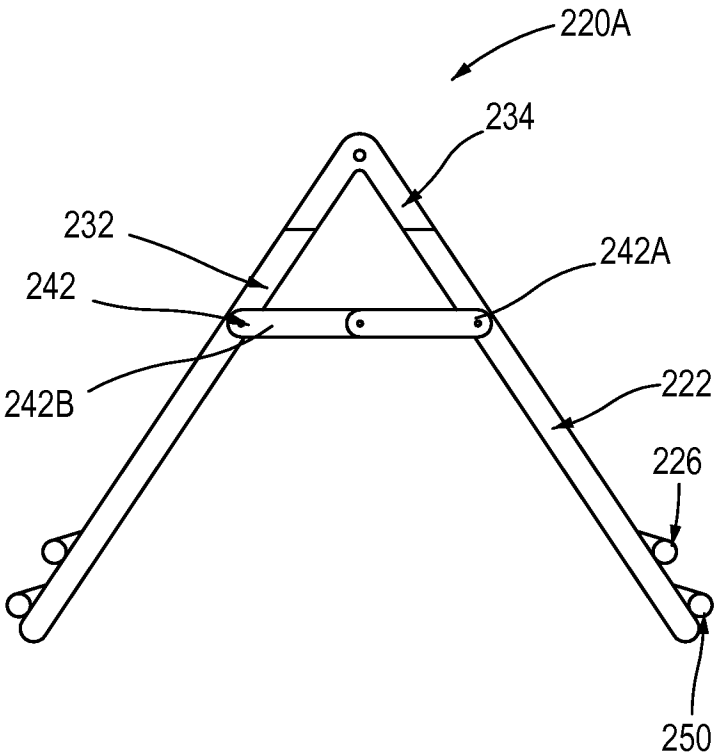
FIG. 9 is an end view of the frame of FIG. 3 disposed in an open configuration.
Figure 12:
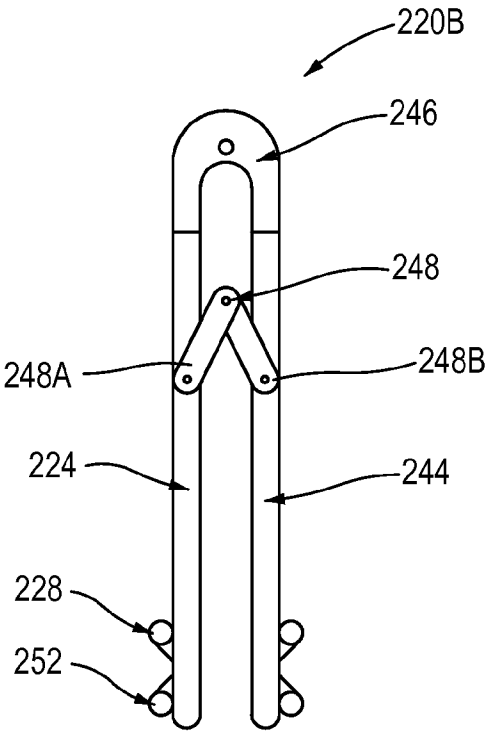
FIG. 12 is another end view of the frame of FIG. 3 disposed in a closed configuration.
Figure 11:
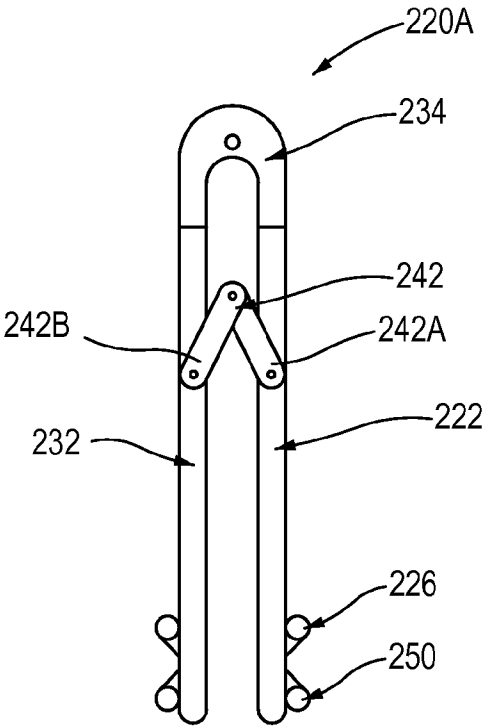
FIG. 11 is an end view of the frame of FIG. 3 disposed in a closed configuration.
Figure 13:
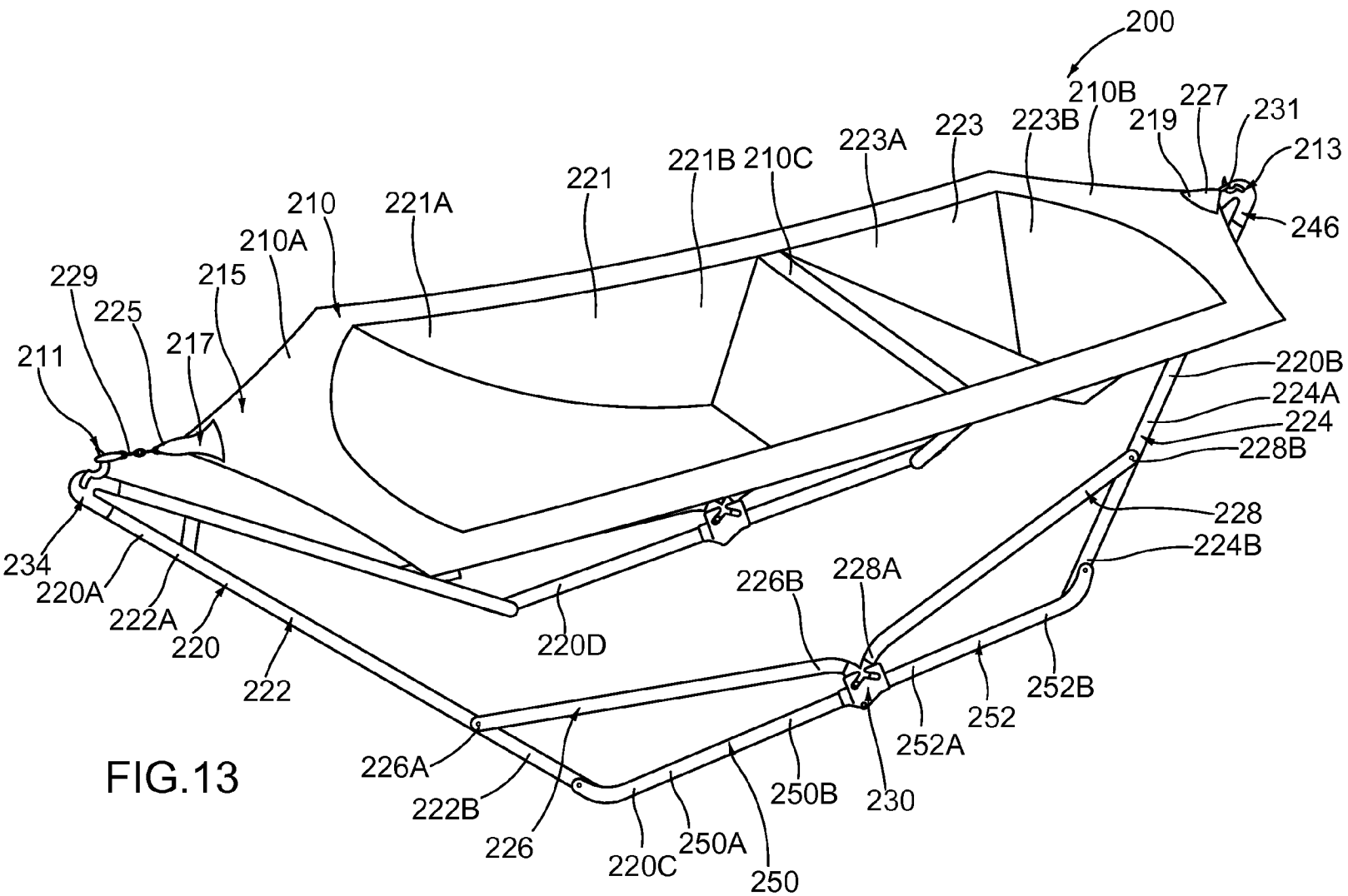
FIG. 13 is a perspective view of the support of FIG. 2 disposed in a first expanded configuration.
Figure 14:
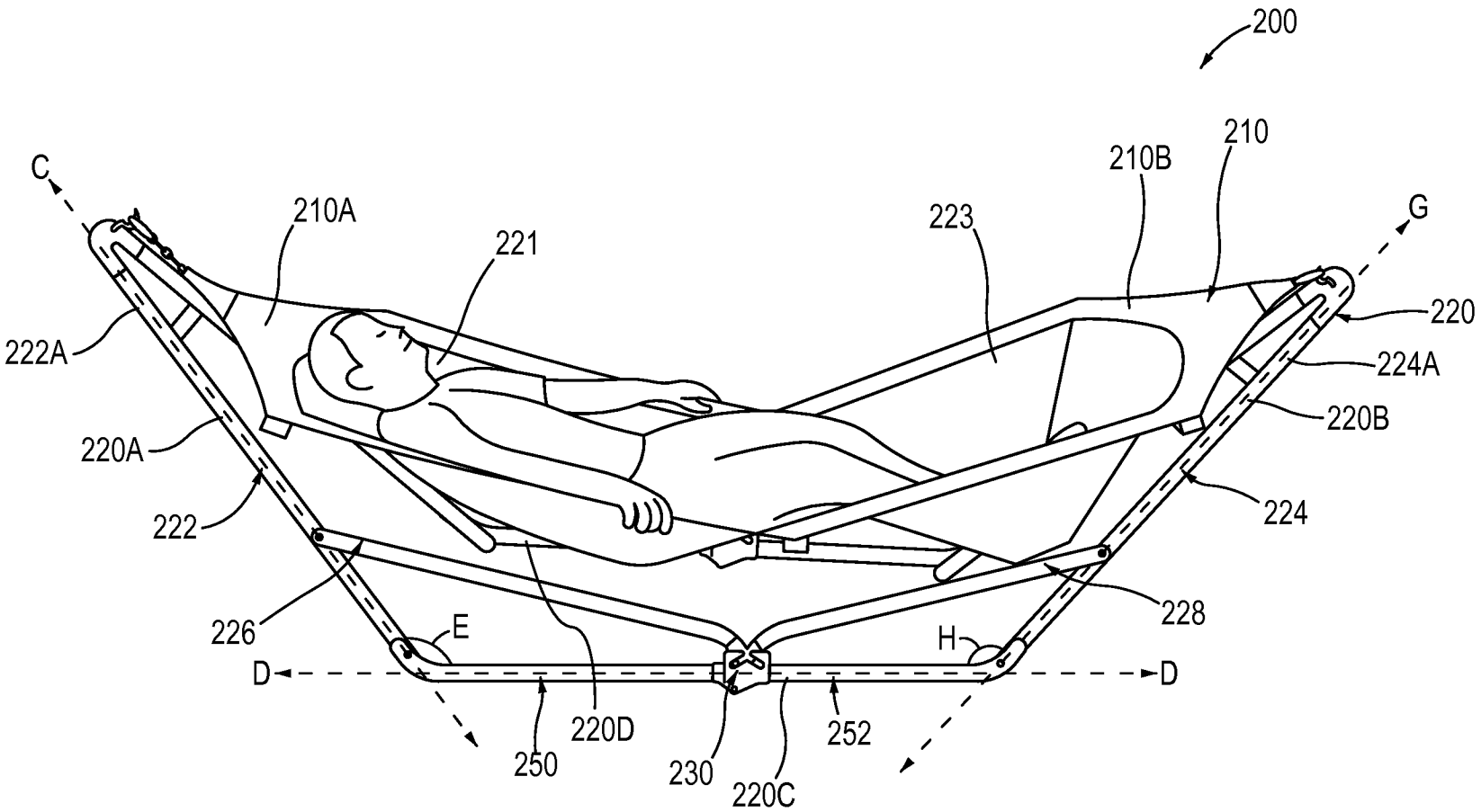
FIG. 14 is a perspective view of the support of FIG. 13 with a user being supported by the support.
Figure 15:
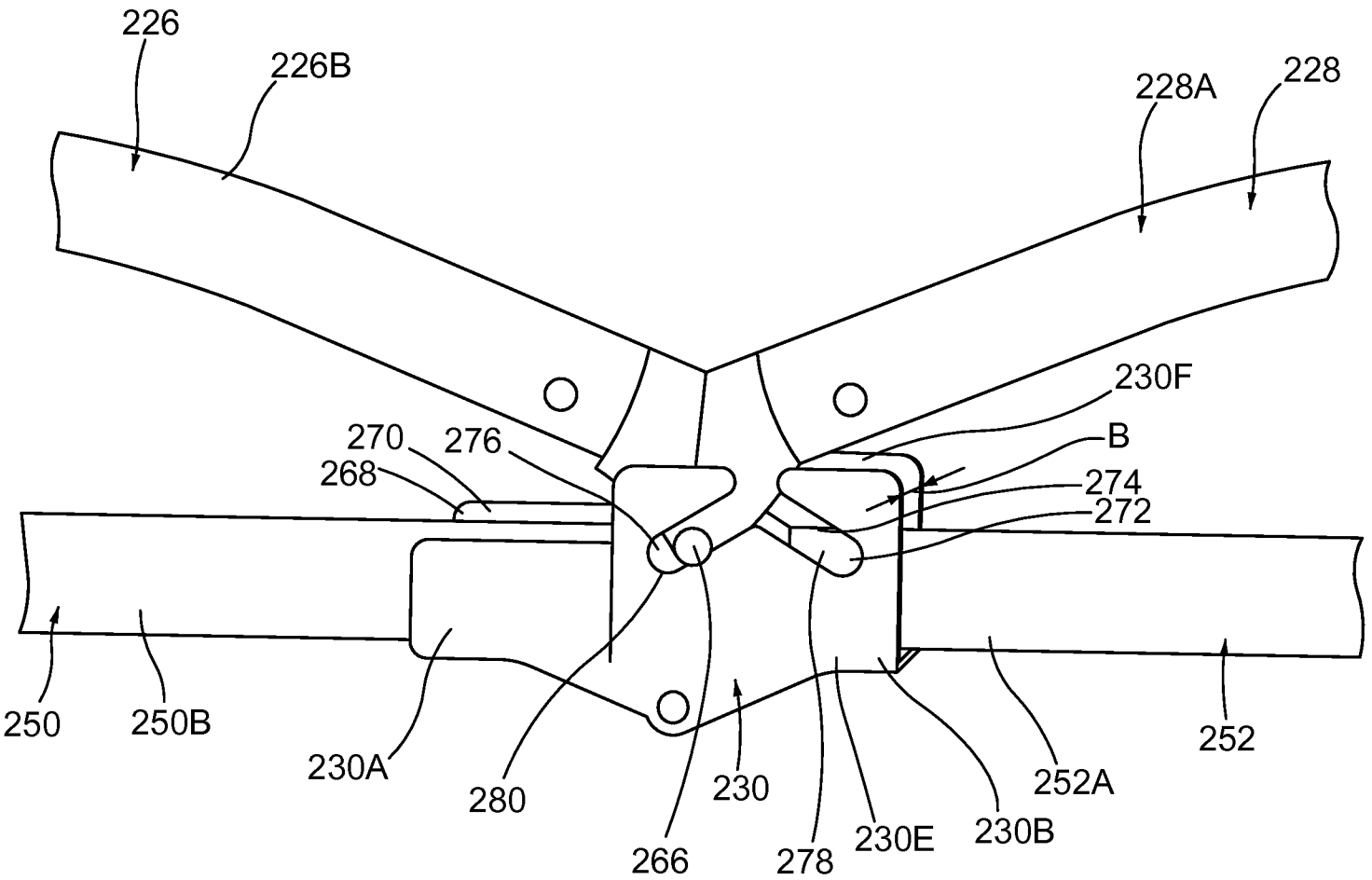
FIG. 15 is a side view of a coupling member of a first side of the support of FIG. 13.
Figure 15A:
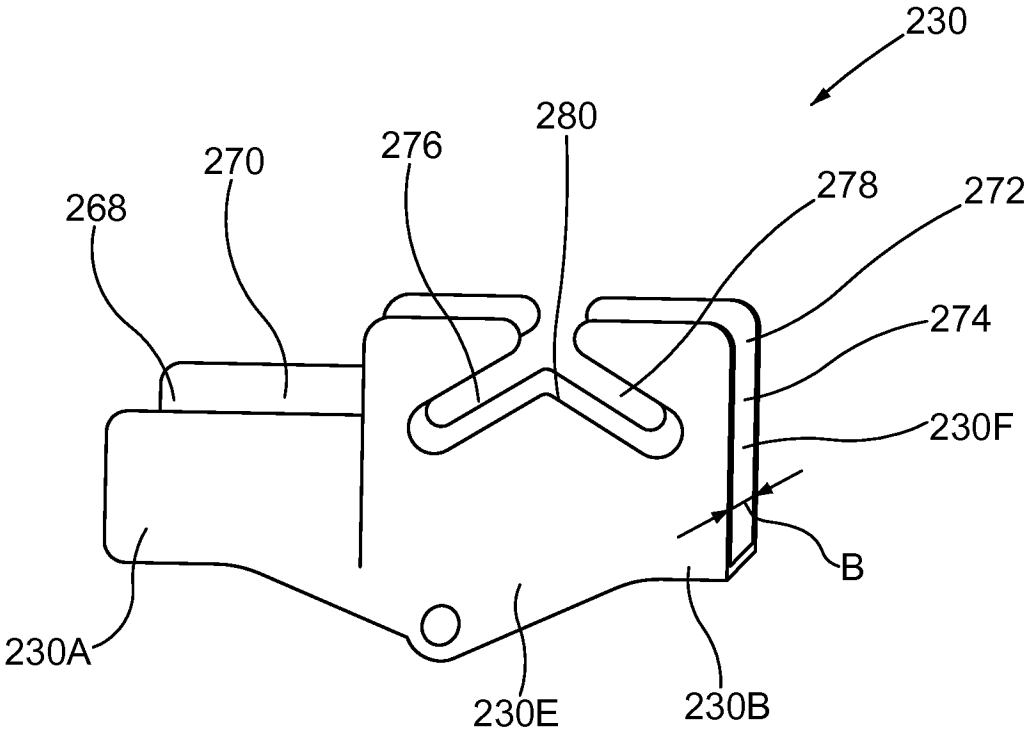
FIG. 15A is perspective view of the coupling member of FIG. 15.
Figure 16:
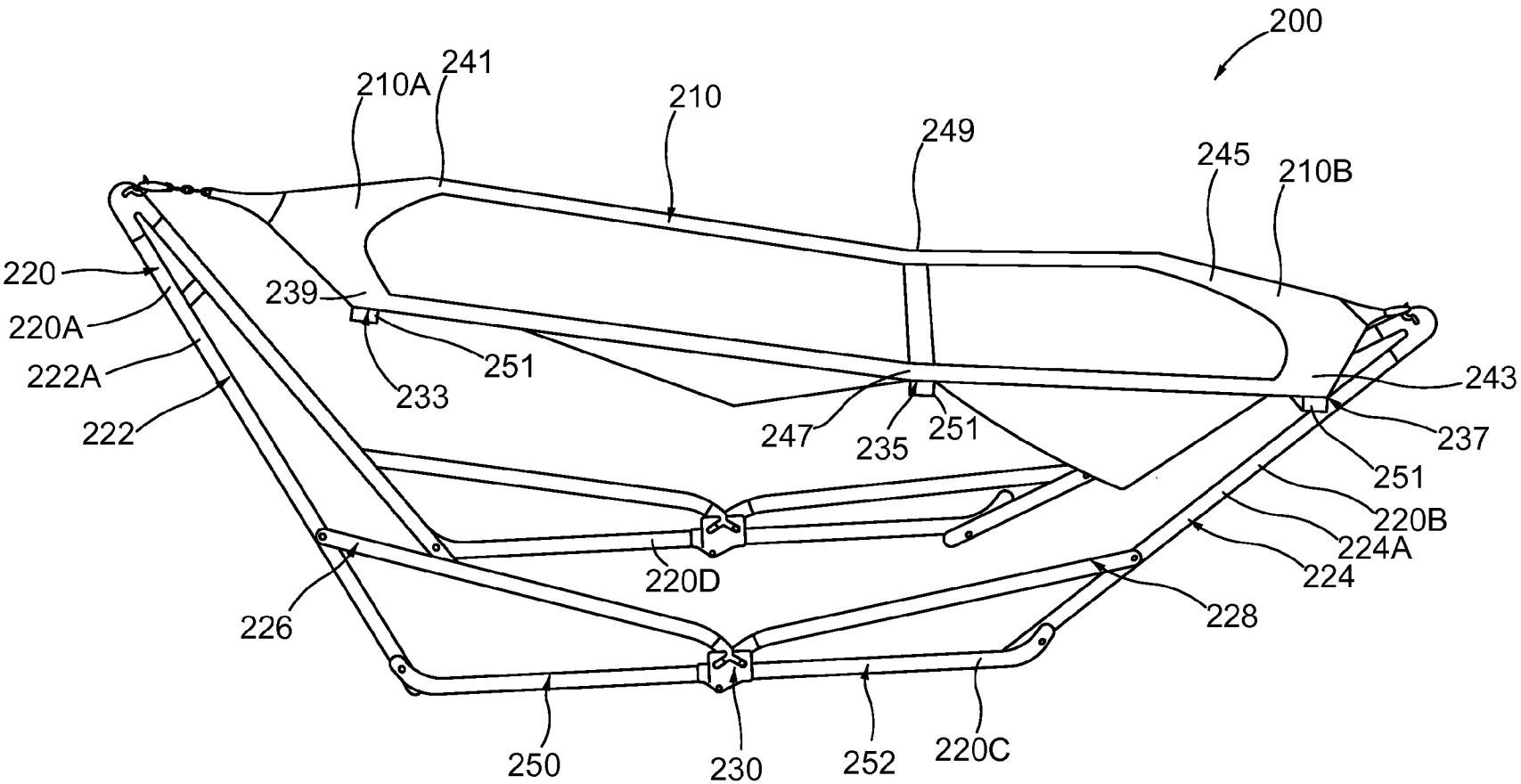
FIG. 16 is a perspective view of the support of FIG. 2 disposed in a second expanded configuration.
Figure 17:
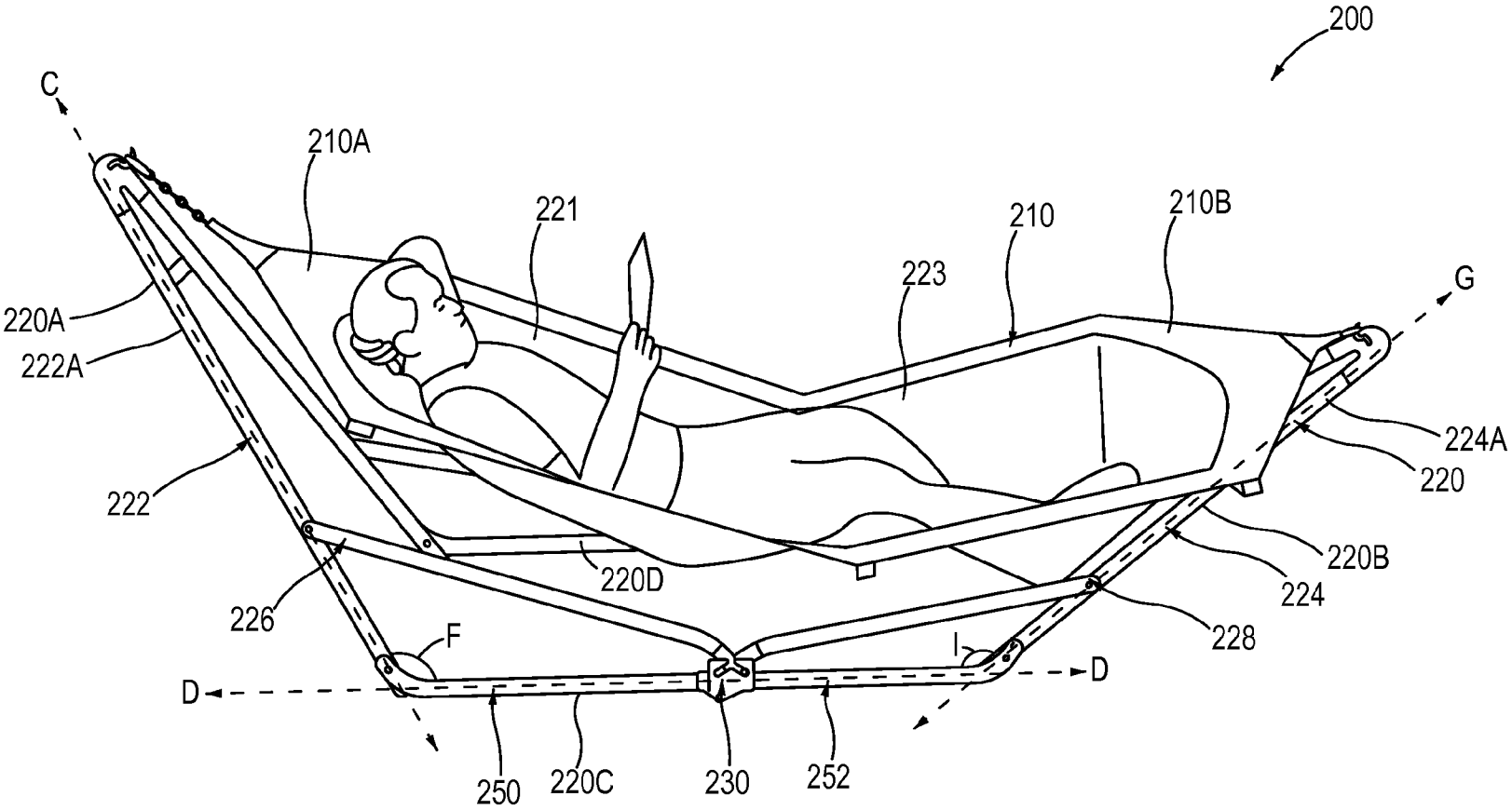
FIG. 17 is a perspective view of the support of FIG. 16 with a user being supported by the support in the second expanded configuration.
Figure 18:
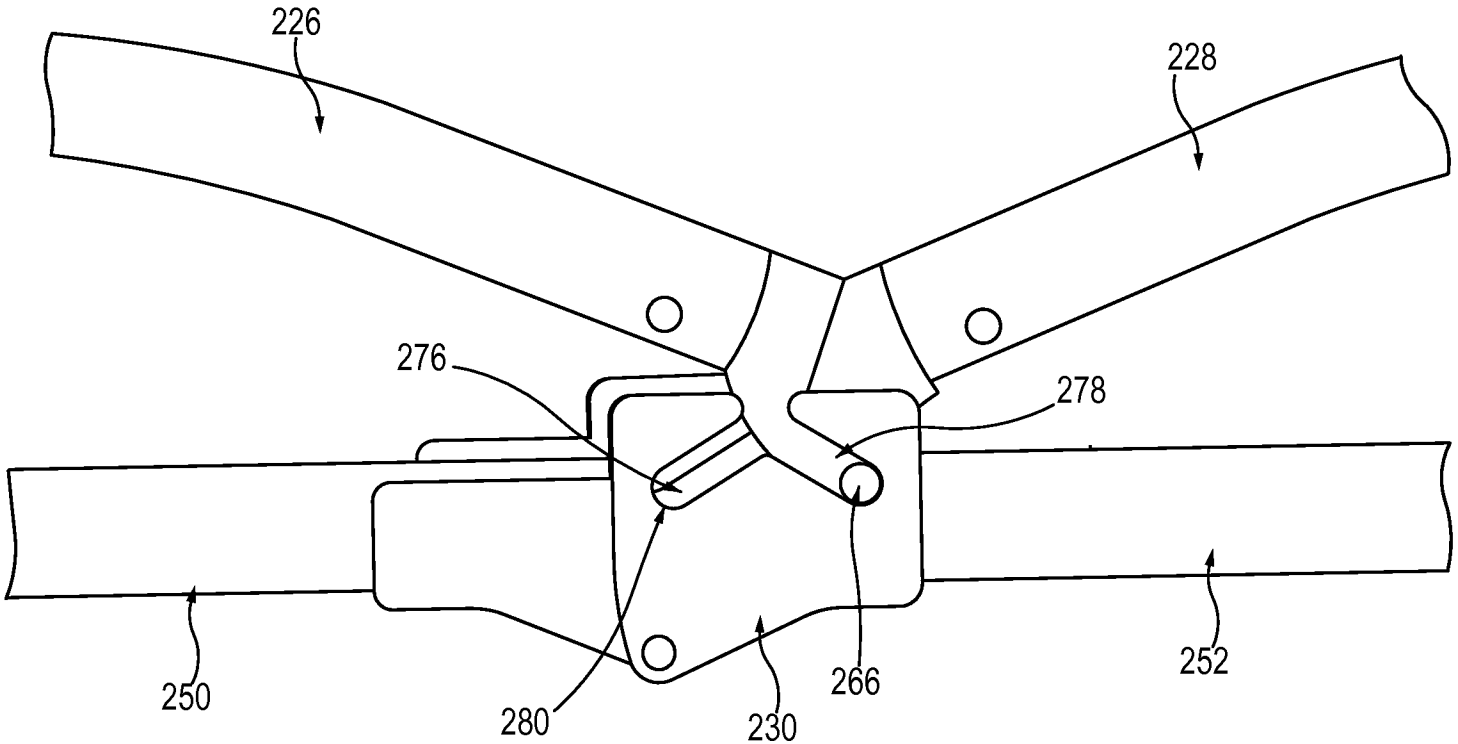
FIG. 18 is a side view of a coupling member of the support of FIG. 16, which is disposed in the second expanded configuration.
Figure 19:
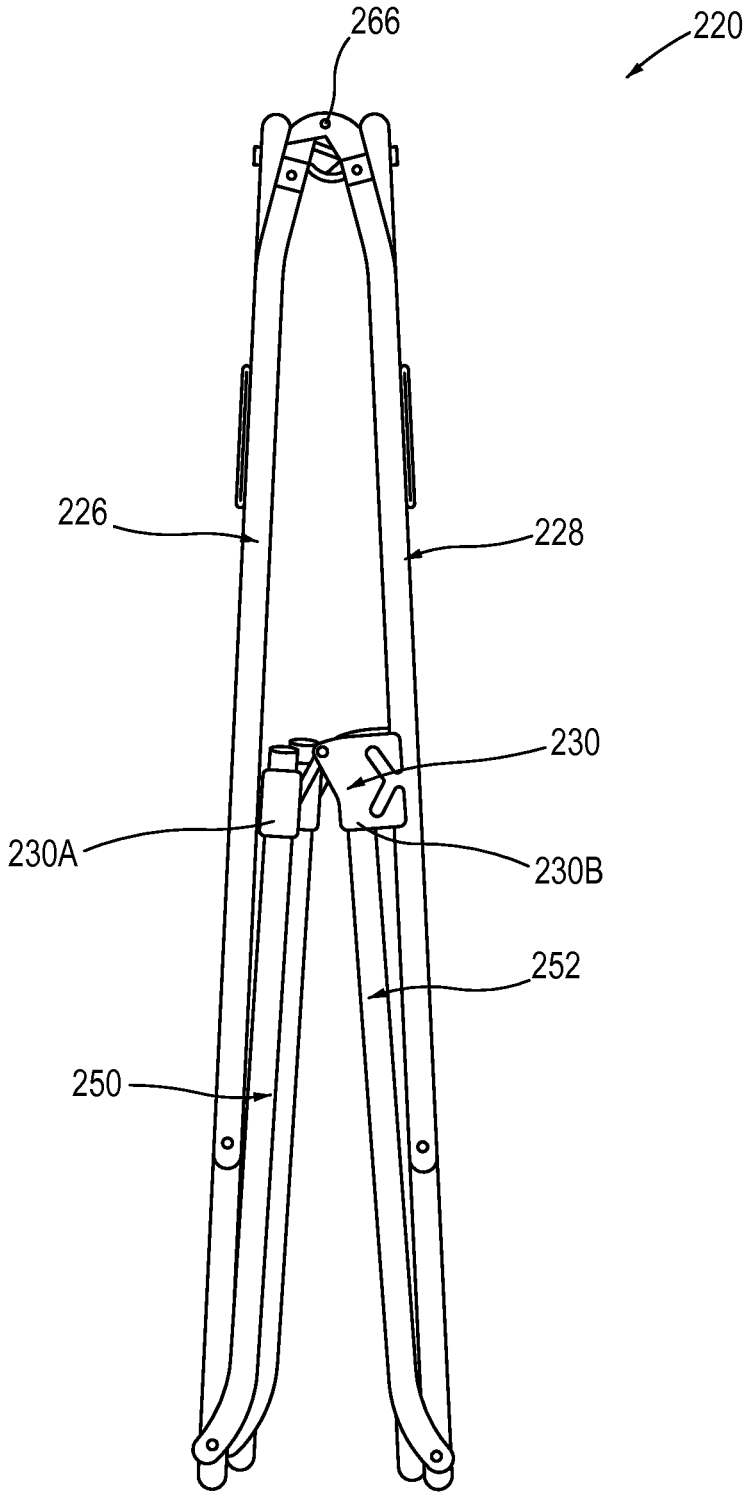
FIG. 19 is a side view of a frame of a support disposed in a collapsed configuration, according to an embodiment.
Figure 20:
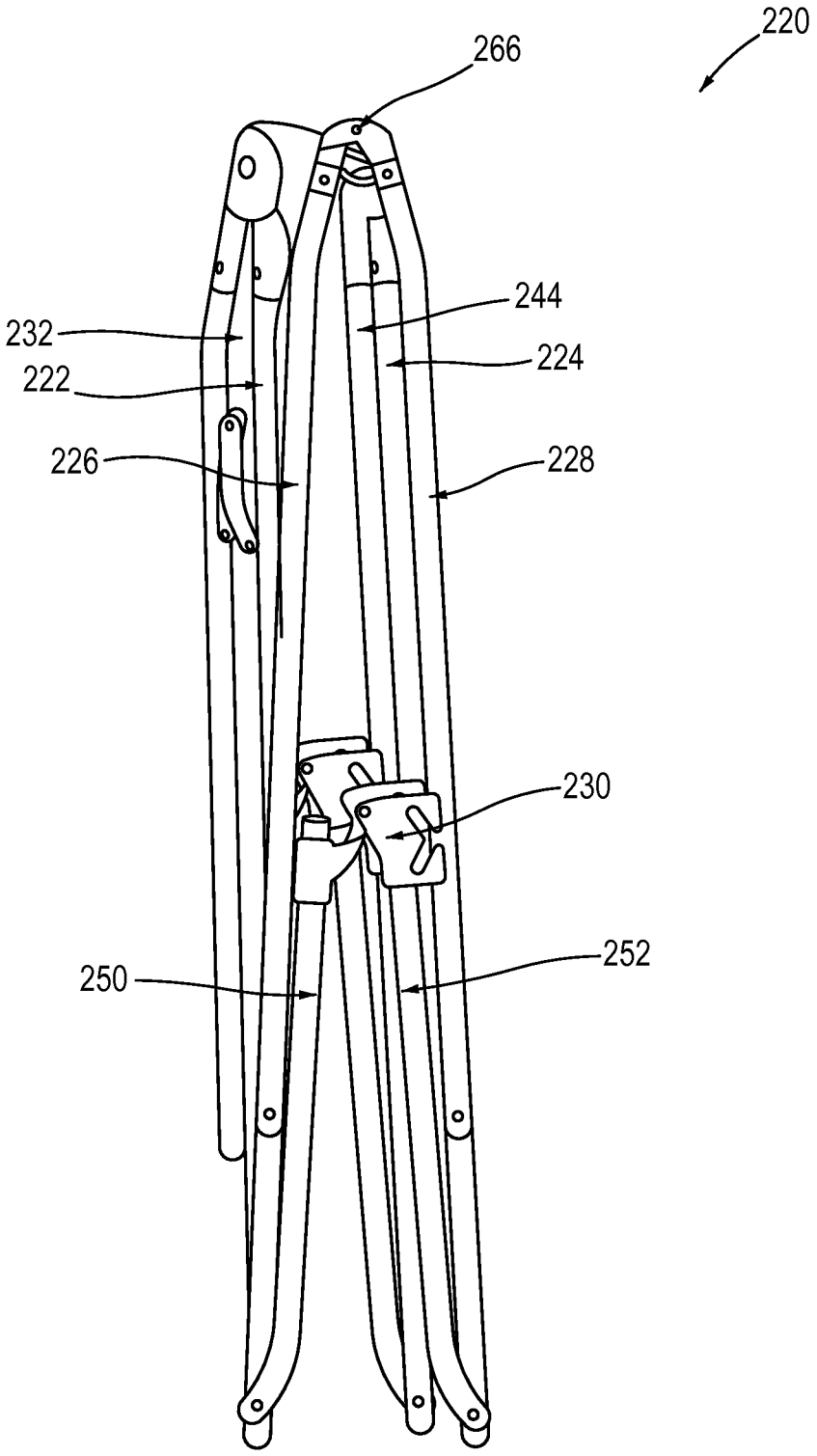
FIG. 20 is a perspective view of the frame of FIG. 19 disposed in a collapsed configuration.
Figure 21:
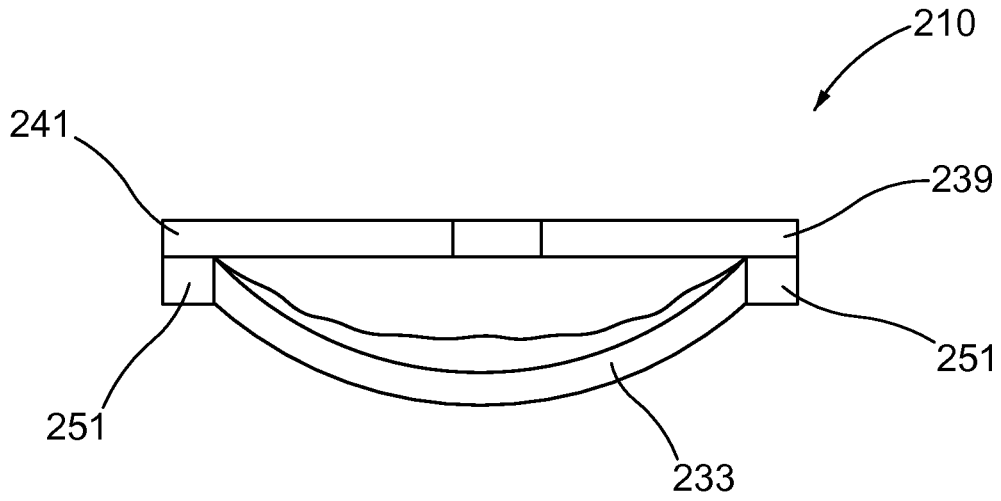
FIG. 21 is an end view of a hammock member, according to an embodiment.
Figure 22:
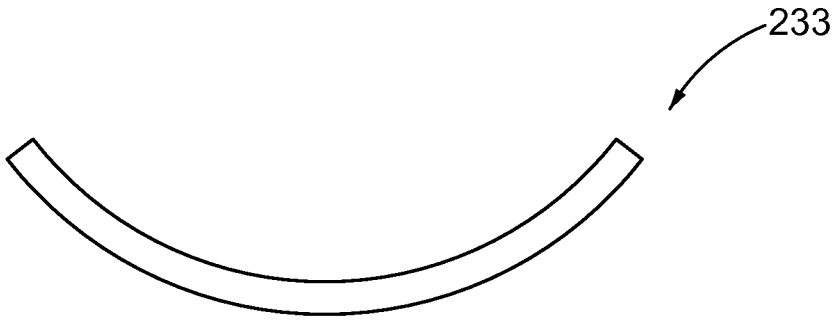
FIG. 22 is a side view of a cross member of the hammock member of FIG. 21.

FIG. 2 illustrates an apparatus or support 200 in a first expanded or first deployed configuration, according to an embodiment of the invention. FIGS. 3-4A are a side view, top view and perspective view of a frame of the support of FIG. 2 disposed in an expanded configuration, respectively. FIGS. 5 and 6 are a side view of a coupler disposed in a closed configuration and a side view of the coupler disposed in an open configuration, respectively. FIG. 7 is a side perspective view of a portion of the coupler of FIG. 5. FIG. 8 is a side perspective view of another portion of the coupler of FIG. 5. FIGS. 9 and 10 are each an end view of the frame of FIG. 3 disposed in an open configuration. FIGS. 11 and 12 are each an end view of the frame of FIG. 3 disposed in a closed configuration (i.e., a partially collapsed configuration). FIG. 13 is a perspective view of the support disposed in a first expanded configuration. FIG. 14 is a perspective view of the support of FIG. 13 with a user being supported by the support. FIG. 15 is a side view of a coupling member of a first side of the support of FIG. 13. FIG. 15A is perspective view of the coupling member of FIG. 15. FIG. 16 is a perspective view of the support disposed in a second expanded configuration. FIG. 17 is a perspective view of the support of FIG. 16 with a user being supported by the support in the second expanded configuration. FIG. 18 is a side view of a coupling member of the support of FIG. 16, which is disposed in the second expanded configuration. FIGS. 19 and 20 are a side view and a perspective view of a frame of a support disposed in a collapsed configuration. FIG. 21 is an end view of a hammock member, according to an embodiment. FIG. 22 is a side view of a cross member of the hammock member of FIG. 21.

In one embodiment, the support 200, in its first and second expanded configurations, can be used as a hammock. The support 200 includes a frame 220 and a hammock member 210 coupled to the frame 220. The frame 220 has a first end portion 220A and a second end portion 220B opposite the first end portion 220A, which are coupled together by a first side portion 220C and a second side portion 220D (see FIG. 4) opposite the first side portion 220C.

In the illustrated embodiment, the first end portion 220A includes a first support member 222 and a second support member 232 as shown in FIGS. 4 and 4A. The first support member 222 is coupled to the second support member 232 such that the first support member 222 pivots, or moves, with respect to the second support member 232 from an open configuration to a closed configuration as shown in FIGS. 9 and 11, respectively. Specifically, the first support member 222 of the first end portion 220A has a first end portion 222A and a second end portion 222B opposite the first end portion 222A. The first end portion 222A of the first support member 222 is coupled to a first coupler 234. Similarly, the second support member 232 has a first end portion 232A and a second end portion 232B opposite the first end portion 232A. The first end portion 232A of the second support member 232 is coupled to the first coupler 234.

As illustrated in FIGS. 5-8, the first coupler 234 includes a first connection portion 236 and a second connection portion 237. The first connection portion 236 is coupled to the first end portion 222A of the first support member 222. The second connection portion 237 is coupled to the first end portion 232A of the second support member 232. The first connection portion 236 and the second connection portion 237 are pivotally coupled via any appropriate means, such as a nut and bolt, a pin, a rivet, or a brad. Therefore, the first coupler 234 is configured to bend or pivot about an axis A, thereby allowing the first support member 222 to pivot or move with respect to the second support member 232.

In the illustrated embodiment, the second connection portion 237 of the first coupler 234 includes a protrusion 238. The protrusion 238 is sized such that the first support member 222 and the second support member 232 are prevented from over-pivoting with respect to each other. For example, as the first support member 222 is pivoted away from the second support member 232, the protrusion 238 moves toward the first connection portion 236 of the first coupler 234. As best illustrated in FIG. 6, the protrusion 238 contacts the first connection portion 236 when the first support member 222 and the second support member 232 are pivoted with respect to each other to an open configuration. The contact between the protrusion 238 and the first connection portion 236 prevents the first support member 222 and the second support member 232 from being pivoted or moved beyond the open configuration.

In some embodiments, the first coupler includes several protrusions. For example, in one embodiment, the first connection portion and the second connection portion may include protrusions that are sized to contact another portion of the first coupler when the support members of the first end portion of the frame are pivoted to an open configuration.

In the illustrated embodiment, a portion of the first support member 222 and a portion of the second support member 232 are received by openings 239 and 240 of the first coupler 234, respectively. In one embodiment, the support members are coupled to the coupler via an adhesive, such as glue. In alternative embodiments, the support members are coupled to the coupler via a screw, a rivet, a pin, or any other coupling mechanism. In a further alternative embodiment, the support members are fit into the openings of the coupler, and are retained via friction. Although the first support member 222 and the second support member 232 are illustrated as being coupled to the coupler at their ends, the support members 222 and 232 need not be coupled to the coupler at their ends.

In an alternative embodiment, the first end portion of the frame does not include a coupler. Rather, the first support member of the first end portion is pivotally coupled to the second support member of the first end portion via a rivet, a nut and bolt, a pin, or any other type of pivoting joint. In another alternative embodiment, the first support member of the first end portion is fixedly coupled to the second support member of the first end portion, and the support members of the first end portion are not configured to pivot with respect to each other.

In another alternative embodiment, the first support member of the first end portion and the second support member of the first end portion are not coupled to one another. For example, the first support member of the first end portion and the second support member of the first end portion are substantially parallel to one another when the frame is in the collapsed or the expanded configurations.

FIGS. 9 and 11 are end views of the of the frame 220 of FIG. 3 disposed in the open configuration and the closed configuration, respectively. As shown in FIGS. 9 and 11, the first end portion 220A of the frame 220 includes a first cross member 242 having a first end portion 242A and a second end portion 242B opposite the first end portion 242A. The first end portion 242A of the first cross member 242 is pivotally coupled to the first support member 222. The second end portion 242B of the first cross member 242 is pivotally coupled to the second support member 232. The first end portion 242A of the first cross member 242 is configured to pivot with respect to the second end portion 242B of the first cross member 242. The first cross member 242 has a non-linear configuration, as shown in FIG. 11, and a linear configuration, as shown in FIG. 9. The first end portion 242A of the first cross member 242 is pivoted with respect to the second end portion 242B of the first cross member 242 when the first cross member 242 is in the non-linear configuration (e.g., a bent or collapsed configuration). The first cross member 242 is disposed in its non-linear configuration when the frame 220 is in its collapsed configuration. The first cross member 242 contributes to the first coupler 234 maintaining the open configuration and, as a result, contributes to the frame 220 maintaining its expanded configuration when the first cross member 242 is in its linear configuration (e.g., a straight or expanded configuration). In the illustrated embodiment, the first end portion 242A and the second end portion 242B are separate pieces that are pivotally coupled together.

As shown in FIGS. 4 and 4A, the second end portion 220B includes a first support member 224 and a second support member 244. The first support member 224 is coupled to the second support member 244 such that the first support member 224 pivots, or moves, with respect to the second support member 244 from an open configuration to a closed configuration as shown in FIGS. 10 and 12, respectively. Specifically, the first support member 224 has a first end portion 224A and second end portion 224B opposite the first end portion 224A. The first end portion 224A of the first support member 224 is coupled to a second coupler 246. Similarly, the second support member 244 has a first end portion 244A and a second end portion 244B opposite the first end portion 244A. The first end portion 244A of the second support member 244 is coupled to the second coupler 246. The second coupler 246 is similar to the first coupler 234 in structure and function.

In an alternative embodiment, the second end portion of the frame does not include the second coupler. Rather, the first support member of the second end portion is pivotally coupled to the second support member of the second end portion via a rivet, a nut and bolt, a pin, or any other type of pivoting joint. In another alternative embodiment, the first support member of the second end portion is fixedly coupled to the second support member of the second end portion, and the support members of the second end portion are not configured to pivot with respect to each other.

As shown in FIGS. 10 and 12, the second end portion 220B of the frame 220 includes a second cross member 248 having a first end portion 248A and a second end portion 248B opposite the first end portion 248A. The first end portion 248A of the second cross member 248 is pivotally coupled to the first support member 224. The second end portion 248B of the second cross member 248 is pivotally coupled to the second support member 244. The first end portion 248A of the second cross member 248 is configured to pivot with respect to the second end portion 248B of the second cross member 248. The second cross member 248 has a non-linear configuration, as shown in FIG. 12, and a linear configuration, as shown in FIG. 10. The first end portion 248A of the second cross member 248 is pivoted with respect to the second end portion 248B when the second cross member 248 is in the non-linear configuration (e.g., a bent or collapsed configuration). The second cross member 248 is disposed in its non-linear configuration when the frame 220 is in its collapsed configuration. The second cross member 248 contributes to the second coupler 246 maintaining the open configuration and, as a result, contributes to the frame 220 maintaining its expanded configuration when the second cross member 248 is in its linear configuration (e.g., a straight or expanded configuration). In the illustrated embodiment, the first end portion 248A and the second end portion 248B are separate pieces that are pivotally coupled together.

In an alternative embodiment, the first support member of the second end portion and the second support member of the second end portion are not coupled to one another. For example, the first support member of the second end portion and the second support member of the second end portion are substantially parallel to one another when the frame is in the collapsed configuration.

As best illustrated in FIGS. 2, 4 and 4A, the first side portion 220C includes multiple connection members 226, 228, 250 and 252 and a coupling member 230. In the illustrated embodiment, the first connection member 226 has a first end portion 226A and a second end portion 226B opposite the first end portion 226A. The first end portion 226A of the first connection member 226 is pivotally coupled to the first support member 222 of the first end portion 220A. Accordingly, the first connection member 226 can pivot or move with respect to the first support member 222 of the first end portion 220A.

In the illustrated embodiment, the second connection member 228 has a first end portion 228A and a second end portion 228B opposite the first end portion 228A. The second end portion 228B of the second connection member 228 is pivotally coupled to the first support member 224 of the second end portion 220B. Accordingly, the second connection member 228 can pivot or move with respect to the first support member 224 of the second end portion 220B.

In the illustrated embodiment, the third connection member 250 has a first end portion 250A and a second end portion 250B opposite the first end portion 250A. The first end portion 250A of the third connection member 250 is pivotally coupled to the second end portion 222B of the first support member 222 of the first end portion 220A. Accordingly, the third connection member 250 can pivot or move with respect to the first support member 222 of the first end portion 220A. The first end portion 250A of the third connection member 250 is curved or bent.

In the illustrated embodiment, the fourth connection member 252 has a first end portion 252A and a second end portion 252B opposite the first end portion 252A. The second end portion 252B of the fourth connection member 252 is pivotally coupled to the second end portion 224B of the first support member 224 of the second end portion 220B. Accordingly, the fourth connection member 252 can pivot or move with respect to the first support member 224 of the second end portion 220B. The second end portion 252B of the fourth connection member 252 is curved or bent.

Although in the illustrated embodiment the connection members 226, 228, 250 and 252 are coupled to the outside side portion of the support members 222 and 224, in an alternative embodiment, the connection members are coupled to the inside side portion of the support members.

As best illustrated in FIGS. 15, 15A and 18, the second end portion 226B of the first connection member 226 is pivotally coupled to the first end portion 228A of the second connection member 228 via a pin 266. Accordingly, the first connection member 226 can pivot or move with respect to the second connection member 228. The second end portion 226B of the first connection member 226 is curved or bent. The first end portion 228A of the second connection member 228 is curved or bent. In some embodiments, one or more of the connection members are linear or straight.

In some embodiments, the first connection member is pivotally coupled to the second connection member via a second coupling member. In some such embodiments, a first end portion of the second coupling member includes a contact surface. Similarly, a second end portion of the second coupling member includes a contact surface. The contact surface of the first end portion contacts or abuts the contact surface of the second end portion when the frame is in one of its expanded configurations. In other words, the contact surfaces of the second coupling member prevent the second coupling member from over pivoting when the frame is in one of its expanded configurations.

The coupling member 230 has a first end portion 230A and a second end portion 230B opposite the first end portion 230A. The second end portion 250B of the third connection member 250 is coupled to the first end portion 230A of the coupling member 230. Specifically, the first end portion 230A of the coupling member 230 defines a channel 268 and an opening 270 in communication with the channel 268. The second end portion 250B of the third connection member 250 is disposed within the channel 268 such that the third connection member 250 is fixedly coupled to the first end portion 230A of the coupling member 230. The coupling can be fixed via glue, friction, welding, a pin, etc. In some embodiments, the third connection member and the first end portion of the first coupling member are unitarily formed. In an alternative embodiment, the third connection member is removably coupled to the coupling member.

The first end portion 252A of the fourth connection member 252 is coupled to the second end portion 230B of the coupling member 230. Specifically, the second end portion 230B defines a channel 272 and an opening 274 in communication with the channel 272. The first end portion 252A of the fourth connection member 252 is disposed within the channel 272 such that the fourth connection member 252 is fixedly coupled to the second end portion 230B of the coupling member 230. The coupling can be fixed via glue, friction, welding, a pin, etc. In some embodiments, the fourth connection member and the second end portion of the first coupling member are unitarily formed. In an alternative embodiment, the fourth connection member is removably coupled to the coupling member.

The first end portion 230A of the coupling member 230 can pivot or move with respect to the second end portion 230B of the coupling member 230. Accordingly, the third connection member 250 can pivot or move with respect to the fourth connection member 252. In the illustrated embodiment, the first end portion 230A of the coupling member 230 and the second end portion 230B of the coupling member 230 are separate pieces that are pivotally coupled together. In some embodiments, first end portion of the coupling member includes a contact surface. The second end portion of the coupling member includes a contact surface. The contact surface of the first end portion contacts or abuts the contact surface of the second end portion when the frame is in one of its expanded configurations. Said differently, the contact surfaces and of the coupling member prevent the coupling member from over pivoting when the frame is in one of its expanded configurations.

The second end portion 230B of the coupling member 230 has a first side portion 230E and a second side portion 230F opposite the first side portion 230E. The first side portion 230E defines a first opening or slot 276 and a second opening or slot 278 in communication with the first opening or slot 276. Specifically, the first side portion 230E includes an edge 280, which defines the slots 276 and 278. The slots 276 and 278 have a width configured to receive the pin 266. The pin 266 is configured to engage the edge 280 defining the slots 276 and 278 such that the pin 266 slidably and removably couples to the coupling member 230 when the frame 220 is in one of its expanded configurations.

As best illustrated in FIG. 15A, the second side portion 230F of the second end portion 230B of the coupling member 230 has similar components and function. Thus, only the first side portion 230E is described in detail.

The first side portion 230E of the second end portion 230B of the coupling member 230 is separate from the second side portion 230F of the second end portion 230B of the coupling member 230 by a distance B. The distance B is sufficient for the first and second connection members 226 and 228 other than the pin 266 to be disposed between the first side portion 230E and the second side portion 230F.

In the illustrated embodiment, any member that is pivotally coupled to another member can be coupled via a nut and bolt, a rivet, or a pin that extends through at least a portion of one member and through at least a portion of the other member. In alternative embodiments, other connection mechanisms, such as, for example, brads, hinges, or any other type of pivoting joints, are used to couple a member to another member. In some embodiments, a first member can be adjacent to or in contact with a second member when the first member is coupled to the second member along a side of the second member.

As best illustrated in FIG. 4, the second side portion 220D is a mirror of the first side portion 220C and includes similar components and function. Thus, only the first side portion 220C is described in detail.

In the illustrated embodiment, the support members 222, 224, 232 and 244 and the connection members 226, 228, 250 and 252 are hollow, metal tubes, such as steel tubes. Alternatively, these members can be formed of any material and configured in any cross-sectional shape that provides sufficient structural strength to support a user. For example, the support members 222, 224, 232 and 244 can be aluminum tubes, plastic tubes, or solid metal or plastic bars. These support members can have a square cross-section, a circular cross-section, a rectangular cross-section, or the like.

The frame 220 is movable between a collapsed configuration as shown in FIGS. 19 and 20 and expanded configurations as shown in FIGS. 3 and 4. The third and fourth connection members 250 and 252 are substantially parallel to a support surface when the frame 220 is in one of its expanded configurations. The frame 220 remains in its expanded configurations when it is placed in such configurations until converted to its collapsed configuration. In other words, the frame 220 is self-supporting when in its expanded configurations without the need for external forces to maintain the frame 220 in its expanded configurations. The cross members 242 and 248 contribute to the frame 220 remaining in the expanded configuration when the frame 220 is placed in such configuration. In some embodiments, the frame is substantially U-shaped or has a slanted U-shape (or a V-shape) when viewed from a side.

As best illustrated in FIGS. 3, 4 and 4A, when the frame 220 is disposed in one of its expanded configurations, the first end portion 220A and the second end portion 220B are slanted with respect to each other. In other words, the first end portion 220A and the second end portion 220B are disposed in a non-parallel relationship and a non-perpendicular relationship when the frame 220 is disposed in one of its expanded configurations. In the illustrated embodiment, the distance between the first coupler 234 and the second coupler 246 is greater than the distance between the second end portion 222B of the first support member 222 of the first end portion 220A and the second end portion 224B of the first support member 224 of the second end portion 220B. Similarly, the distance between the first coupler 234 and the second coupler 246 is greater than the distance between the second end portion 232B of the second support member 232 of the first end portion 220A and the second end portion 244B of the second support member 244 of the second end portion 220B. Additionally, when the frame 220 is in one of its expanded configurations, the support members 222 and 232 of the first end portion 220A are pivoted or moved apart from each other (e.g., they are in their open configuration). Similarly, when the frame 220 is in its expanded configuration, the support members 224 and 244 of the second end portion 220B are pivoted or moved apart from each other (e.g., they are in their open configuration).

The frame 220 of the support 200 has a first expanded configuration as shown in FIGS. 13 and 14 and a second expanded configuration as shown in FIGS. 16 and 17 different from the first expanded configuration. The support 200 is configured to support a user as shown in FIG. 14 such that the user is substantially parallel to a support surface (not shown) when the frame 220 is in its first expanded configuration (i.e., a reclined expanded configuration). In other words, the user can lay on the hammock member 210 when the frame 220 is in its first expanded configuration. The support 200 is configured to support the user as shown in FIG. 17 such that the user is inclined with respect to the support surface when the frame 220 is in its second expanded configuration (i.e., an upright expanded configuration). Said differently, the user can sit on the hammock member 210 when the frame 220 is in its second expanded configuration.

As best illustrated in FIG. 14, the first support member 222 of the first end portion 220A defines a longitudinal axis C. The third connection member 250 defines a longitudinal axis D. The longitudinal axis C defined by the first support member 222 and the longitudinal axis D defined by the third connection member 250 collectively form an angle E when the frame 220 is in its first expanded configuration. Thus, the first end portion 222A of the first support member 222 of the first end portion 220A is separated from the support surface by a distance (not shown) orthogonal to the support surface when the frame 220 is in its first expanded configuration.

Similarly, as best illustrated in FIG. 14, the first support member 224 of the second end portion 220B defines a longitudinal axis G. The fourth connection member 252 defines a longitudinal axis D, which is the same longitudinal axis D that defines the third connection member 250, when the frame 220 is in one of its expanded configurations. The longitudinal axis G defined by the first support member 224 and the longitudinal axis D defined by the fourth connection member 252 collectively form an angle H when the frame 220 is in its first expanded configuration. Thus, the first end portion 224A of the first support member 224 of the second end portion 220B is separated from the support surface by a distance (not shown) orthogonal to the support surface when the frame 220 is in its first expanded configuration. The distance between first end portion 224A and the support surface is substantially equal to the distance between the first end portion 222A and the support surface when the frame 220 is in its first expanded configuration. Accordingly, a first end portion 210A of the hammock member 210 is substantially level with respect to a second end portion 210B of the hammock member 210 when the frame 220 is in its first expanded configuration as shown in FIGS. 13 and 14.

As best illustrated in FIG. 17, the longitudinal axis C defined by the first support member 222 and the longitudinal axis D defined by the third connection member 250 collectively form an angle F when the frame 220 is in its second expanded configuration. The angle F is less than the angle E because movement of the connection member 226 in a direction away from support member 222 causes support member 222 to pivot about its connection to member 250 into a more vertical orientation. (Similarly, movement of the connection member 226 in a direction towards support member 222 causes support member 222 to pivot about its connection to member 250 in more horizontal orientation.) In other words, the first end portion 222A of the first support member 222 of the first end portion 220A is separated from the support surface by a distance (not shown) orthogonal to the support surface when the frame 220 is in its second expanded configuration. The distance between the first end portion 222A and the support surface when the frame 220 is in the second expanded configuration is greater than the distance between the first end portion 222A and the support surface when the frame 220 is in the first expanded configuration.

As best illustrated in FIG. 17, the longitudinal axis G defined by the first support member 224 and the longitudinal axis D defined by the fourth connection member 252 collectively form an angle I when the frame 220 is in its second expanded configuration. The angle I is greater than the angle H. In other words, the first end portion 224A of the first support member 224 of the second end portion 220B is separated from the support surface by a distance (not shown) orthogonal to the support surface when the frame 220 is in its second expanded configuration. The distance between the first end portion 224A of the first support member 224 of the second end portion 220B and the support surface is less than the distance between the first end portion 222A of the first support member 222 of the first end portion 220A and the support surface. Accordingly, the first end portion 210A of the hammock member 210 is elevated above the second end portion 210B of the hammock member 210 with respect to the support surface. The distance between the first end portion 224A and the support surface when the frame 220 is in the second expanded configuration is less than the distance between the first end portion 224A and the support surface when the frame 220 is in the first expanded configuration.

In some embodiments, the longitudinal axis defined by the third connection member is offset from the longitudinal axis defined by the fourth connection member when the frame is in one of its expanded configurations.

As best illustrated in FIGS. 15 and 18, the position of the pin 266 relative to the coupling member 230 determines whether the frame 220 is in its first expanded configuration, its second expanded configuration or its collapsed configuration. Specifically, the frame 220 is in its first expanded configuration when the pin 266 is coupled to the coupling member 230 within the first slot 276 as shown in FIG. 15. The frame 220 is in its second expanded configuration when the pin 266 is coupled to the coupling member 230 within the second slot 278 as shown in FIG. 18.

The frame 220 is moveable between the first expanded configuration and the second expanded configuration. Specifically, as the pin 266 moves from one slot to the other slot, the first connection member 226 and the second connection member 228 pivot or rotate with respect to the first support member 222 of the first end portion 220A and the first support member 224 of the second end portion end portion 220B, respectively. Accordingly, the frame 220 is moved from its first expanded configuration to its second expanded configuration. In some embodiments, the frame 220 is moveable between the first expanded configuration (i.e., a reclined expanded configuration) and the second expanded configuration (i.e., an upright expanded configuration) when the hammock member 210 is coupled to the frame 220. Said differently, the frame 220 can be moved between its first expanded configuration and its second expanded configuration while the hammock member 210 is coupled to the frame 220.

As best illustrated in FIGS. 19 and 20, when the frame 220 is in its collapsed configuration, the support members 222, 224, 232 and 244 and the connection members 226, 228, 250 and 252 are substantially parallel to each other. In the illustrated embodiment, they are closer to being parallel than they are to being perpendicular.

As best illustrated in FIGS. 19 and 20, the frame 220 may be converted from one of the expanded configurations to the collapsed configuration. To convert the frame 220 from one of its expanded configurations to its collapsed configuration, the first side portion 220C of the frame 220 and the second side portion 220D of the frame 220 are moved together. Specifically, the support members 222, 224, 232 and 244 are moved from the open configuration to the closed configuration as illustrated in FIGS. 11 and 12. For example, the first support member 222 of the first end portion 220A may be pivoted towards the second support member 232 of the first end portion 220A. The first support member 224 of the second end portion 220B may be pivoted towards the second support member 244 of the second end portion 220B. In a step of converting the frame 220 from its expanded configuration to its collapsed configuration, the first and second cross members 242 and 248 are moved from their linear configuration to their non-linear configuration.

The pivoting of the connection members 226, 228, 250 and 252 of the first side portion 220C cause the first end portion 220A to be moved towards the second end portion 220B of the frame 220. Specifically, the pivoting of the first and third connection embers 226 and 250 of the first side portion 220C cause the first and second support members 222 and 232 of the first end portion 220A to be moved towards the coupling member 230. In other words, the first and third connection members 226 and 250 of the first side portion 220C are pivoted with respect to the first support member 222 of the first end portion 220A.

Similarly, the pivoting of the second and fourth connection members 228 and 252 of the first side portion 220C cause the first and second support members 224 and 244 of the second end portion 220B to be moved towards the coupling member 230. Said differently, the second and fourth connection members 224 and 244 of the first side portion 220C are pivoted with respect to the first support member 224 of the second end portion 220B.

The position of the pin 266 with respect to the coupling member 230 determines whether the frame 220 is in its first expanded configuration, its second expanded configuration, or its collapsed configuration. The frame 220 is moveable between its expanded configurations and its collapsed configuration. Specifically, moving the pin 266 away from the coupling member 230 causes the frame 220 to move from one of its expanded configurations to its collapsed configuration. Similarly, moving the pin 266 towards the coupling member 230 causes the frame 220 to move from its collapsed configuration to one of its expanded configurations.

As best illustrated in FIGS. 13, 14, 16 and 17, the first end portion 220A of the frame 220 includes a first hook 211 coupled to the first coupler 234. The first hook 211 is configured to couple to the hammock member 210. The second end portion 220B of the frame 220 includes a second hook 213 coupled to the second coupler 246. The second hook 213 is configured to couple to the hammock member 210. In an alternative embodiment, the first end portion and the second end portion of the frame do not include a hook. Rather, the first end portion and the second end portion of the frame are each coupled to the hammock member via a clip, nut and bolt, or any other coupling mechanism. In another alternative embodiment, the hammock member has a hook configured to couple to a hole defined by the frame or a chain coupled to the frame.

In the illustrated embodiment, the hammock member 210 of the support 200 is coupled to the hooks 211 and 213 of the frame 220, and is suspended between the hooks 211 and 213 when the frame 220 is in its deployed or expanded configuration as shown in FIG. 2. When the hammock member 210 is suspended between the hooks 211 and 213 of the frame 220, the hammock member 210 is configured to receive and support a user. As best illustrated in FIG. 13, the hammock member 210 includes a membrane portion 215 and coupling portions 217 and 219.

As best illustrated in FIG. 13, the hammock member 210 has a first end portion 210A and second end portion 210B opposite the first end portion 210A. The hammock member has a middle portion 210C disposed between the first end portion 210A of the hammock member 210 and the second end portion 210B of the hammock member 210. The region 221 includes more membrane or fabric at a center of the region 221 than at the edges of the region 221, allowing the region 221 to have a wedge-like form to receive the user. In some embodiments, the region has a cup-like form. In some embodiments, the region is darted.

The region 221 is tapered. In other words, a depth of the region 221 increases along the length of the region 221. Specifically, the region 221 has a first end portion 221A and a second end portion 221B opposite the first end portion 221A. The second end portion 221B includes more fabric than the first end portion 221A. Accordingly, a height (i.e., depth) at the first end portion 221A is less than a height (i.e., depth) at the second end portion 221B.

Similarly, the region 223 includes more membrane or fabric at a center of the region 223 than at the edges of the region 223, allowing the region 223 to have a wedge-like form to receive the user. In some embodiments, the region has a cup-like form. In some embodiments, the region is darted.

The region 223 is tapered. In other words, a depth of the region 223 increases along the length of the region 223. Specifically, the region 223 has a first end portion 223A and a second end portion 223B opposite the first end portion 223A. The second end portion 223B includes more fabric than the first end portion 223A. Accordingly, a height (i.e., depth) at the first end portion 223A is less than a height (i.e., depth) at the second end portion 223B.

As best illustrated in FIGS. 14 and 17, the length of region 221 is longer than the length of region 223 such that the region 221 can receive an upper portion or torso portion of the user and the region 223 can receive a lower portion or leg portion of the user. The depths of the regions 221 and 223 can range from 1 inch to 12 inches.

In this embodiment, the membrane portion 215 is a layer of material, such as a layer of nylon or neoprene, or any other material of sufficient strength to support a user. In an alternative embodiment, the membrane portion is several pieces of material that form a mesh or multiple layers of different materials. In some embodiments, the membrane portion has a first portion and a second portion different from the first portion. The first portion of the membrane portion is a substantially rigid material. The second portion of the membrane portion is a substantially flexible material. For example, the edges (e.g., the outer perimeter) of the hammock member can be a rigid material and the pockets (e.g., an inner portion) of the hammock member can be a flexible material. In some embodiments, the hammock member has a frame coupled to at least a portion of a perimeter of the hammock member.

As shown in FIG. 13, each of the coupling portions 217 and 219 has a coupling strap 225 and 227, respectively. The coupling straps 225 and 227 are coupled to coupling rings 229 and 231, respectively. The coupling straps 225 and 227 are respectively threaded through the coupling rings 229 and 237 and both ends of the coupling straps 229 and 231 are coupled to the hammock member 210. It should be understood that any coupling mechanisms can be used, such as, for example, sewing, clips, hook and loop, ball-and-sockets, etc. can be used to couple the straps to the hammock member.

In the illustrated embodiment, the coupling rings 229 and 231 interact with hooks 211 and 213, which are coupled to the couplers 234 and 246 of the frame 220, respectively, to removably couple the hammock member 210 to the frame 220. In an alternative embodiment, the coupling ring interacts with another portion of the frame to removably or permanently couple the hammock member to the frame.

In alternative embodiments, the coupling portions of the hammock member have coupling lines that are sewn to the membrane portion and are removably tied to the end portions of the frame. In another alternative embodiment, the coupling lines are tied to the membrane portion. In yet another alternative embodiment, the coupling lines are coupled to the membrane portion via glue, staples, or any other known coupling mechanism. In further alternative embodiments, the coupling lines are coupled to the end portions of the frame, respectively, via a clip, a hook, a snap, or any other known coupling mechanism. In a further alternative embodiment, the coupling portions do not include coupling lines and the membrane portion and the coupling portions are a single continuous piece of material. In yet a further alternative embodiment, the membrane portion includes grommets, which interact with the hooks to removably couple the hammock member to the frame.

As best illustrated in FIGS. 2, 16, 21 and 22 the hammock member 210 also includes cross members 233, 235 and 237. The cross members 233, 235 and 237 provide support to the hammock member 210. Specifically, the cross members 233, 235 and 237 retain the hammock member 210 in a spread or open configuration. Cross member 233 is coupled to, and extends between, corners 239 and 241 of the hammock member 210. Similarly, cross member 237 is coupled to, and extends between, corners 243 and 245 of the hammock member 210. Similarly, cross member 235 is coupled to, and extends between, edges 247 and 249 of the hammock member 210. In the illustrated embodiment, the cross members 233, 235 and 237 are coupled to the underside of the hammock member 210 and are of a bent or a non-linear configuration. Thus, in some embodiment, the ends of the cross members 233, 235 and 237 contact the membrane portion 215 while the mid-portions of the support members do not contact the membrane portion 215. For example, at the mid-point of the cross members 233, 235 and 237, the cross members can be, for example, approximately 2 to 6 inches below the membrane portion 215.

In this embodiment, pockets 251 are disposed on the underside of the hammock member 210, and receive and couple the ends of the cross members 233, 235 and 237 to the hammock member 210. In other embodiments, other conventional means, such as sewing or hook-and-loop type mechanisms, are used to removably or permanently couple the cross members to the membrane portion. In some embodiments, the cross members are coupled to the hammock member via sleeves coupled to the hammock member.

In the illustrated embodiment, the cross members 233, 235 and 237 are hollow, metal tubes, such as steel tubes. Alternatively, the cross members 233, 235 and 237 can be formed of any material and configured in any cross-sectional shape that provides sufficient structural strength to retain the hammock member 210 in a spread or open configuration. For example, the cross members 233, 235 and 237 can be aluminum tubes, plastic tubes, solid metal or plastic bars, or wooden bars. In the illustrated embodiment, the cross members 233, 235 and 237 have a rectangular cross-sectional shape. In an alternative embodiments, the cross members have a circular cross-sectional shape or any other shape.

In some embodiments, the membrane portion of the hammock member has a head pillow and/or a leg pillow. The head pillow is disposable at a position to support the head or neck of a user. The head pillow can include an outer shell and filling material disposed within the shell. In other embodiments, the head pillow is an inflatable pillow. The outer shell and/or the hammock member include a coupling mechanism that allows the head pillow to be removably coupled to the hammock member. For example, the outer shell and the hammock member my include a hook-and-loop type coupling mechanism, a snap type coupling mechanism, or any other type of non-permanent coupling mechanism. In an alternative embodiment, the head pillow is fixedly and permanently coupled to the hammock member.

Similar to the head pillow, in some embodiments, a leg pillow is disposable at a position to support the legs of a user. The leg pillow includes an outer shell and filling material disposed within the shell. In an alternative embodiment, the leg pillow is an inflatable pillow. One, or both, of the outer shell and the hammock member include a coupling mechanism that allows the leg pillow to be removably coupled to the hammock member. For example, the outer shell and the hammock member may include a hook-and-loop type coupling mechanism, a snap type coupling mechanism, or any other type of non-permanent coupling mechanism. In an alternative embodiment, the leg pillow is fixedly and permanently coupled to the hammock member.

In some embodiments, the hammock member of the support also includes a beverage pocket and a book pocket. The beverage pocket includes an opening in the hammock member and a receiver portion that is disposed adjacent to, and communicates with, the opening in the hammock member. The receiver portion includes a lower support portion. Thus, a beverage container may be placed in, and supported by, the beverage pocket.

In some embodiments, the receiver portion is sewn to the hammock member. In alternative embodiments, the receiver portion is coupled to the hammock member via another coupling mechanism, such as a hook-and-loop type mechanism.

In some embodiments, the receiver portion of the beverage pocket is made of a single piece of fabric or any other material that would provide the enough strength to support a beverage container. In another embodiment, the receiver portion of the beverage pocket is made of a several pieces of material.

In some embodiments, the book pocket of the hammock member includes an opening in the hammock member and a receiver portion that is disposed adjacent to, and communicates with, the opening in the hammock member. The receiver portion includes a lower support portion. Thus, a book, a magazine, or other reading material may be placed in, and supported by, the book pocket. In such embodiments, a lower support portion is coupled to the hammock member. Thus, when a book or other reading material is placed in the book pocket, the book or reading material is disposed in a parallel relationship to the hammock member.

In some embodiments, the receiver portion of the book pocket is made of a single piece of fabric or any other material that would provide the enough strength to support a book or other reading material. In another embodiment, the receiver portion of the book pocket is made of a several pieces of material.

In some embodiments, the support includes a shade member that includes tethering lines, a membrane portion, and a frame member. The tethering lines are coupled to, and extend between a first end of the membrane portion and the hammock member of the support. Conventional means, such as a releasable coupler, may be used to releasably couple the tethering lines to the first end of the membrane portion and to the hammock member. Alternatively, the first end of the membrane portion and the hammock member may include openings and the tethering lines may be tied to the membrane portion and to the hammock portion. In a further alternative embodiment, the tethering lines may be coupled to, and extend between, the frame portion of the support and the first end of the membrane portion. In another embodiment, a single tethering line is used.

In some embodiments, the support members can telescope between a compact and an extended configuration. In such embodiments, the frame can include wheels coupled to the frame. This "telescoping" arrangement of the support members allows the support members to be placed in an extended, or lengthened, configuration and in a contracted, or shortened, configuration. When in the extended, or lengthened, configuration, the telescoping arrangement allows the frame of the support to fully extend to the intended height, thereby positioning the hammock member sufficiently above the support surface (e.g., the ground). When in the contracted, or shortened configuration the telescoping arrangement allows for compact transportation of the support.

In some embodiments, wheels are rotatably coupled to the second end portion of the frame. The wheels are configured to roll along a support surface to transport the support when the frame is disposed in its expanded configuration and/or its collapsed configuration. In one embodiment, the wheels have locking mechanisms to lock the wheels so as to prevent them from rotating. In alternative embodiments, however, the wheels are coupled to different portions of the support, such as to the side portions or to the first end portion.

In some embodiments, a support strap is coupled to, and extends between, the first side portion of the frame and the second side portion of the frame. The support strap provides support to the frame when the frame is in its expanded configuration. Specifically, the support strap is configured to prevent the first side portion from bowing away from the second side portion when the frame is disposed in its expanded configuration.

While various embodiments of the invention have been described above, it should be understood that they have been presented by way of example only, and not limitation. While specific embodiments have been shown and described, it will be understood that various changes in form and details may be made.

In some embodiments, the frame can include more connection members to extend the length of the frame. In such embodiments, an additional segment can include multiple connection members coupled between the support members of the first end portion and the connection members of the first segment to extend the length of the frame. In other alternative embodiments, the frame can include fewer connections members to shorten the length of the frame.

In yet other alternative embodiments, one or more of the connection members can be coupled to a mid-portion of a support member rather than being coupled to the second end portion of the support member.

In yet other alternative embodiments, the first end portion of the frame includes more than two support members such that the first end portion of the frame is self supporting. Similarly, the second end portion of the frame includes more than two support members such that the second end portion of the frame is self supporting. In such embodiments, the frame need not include the second side portion. In other words, in such alternative embodiments, a single structure (similar to the first side portion or the second side portion) can be located along the center of the frame and each end portion can include a support member to couple to the hammock member and two or more support members that contact the ground. For example, the two or more support members can be horizontally disposed to provide stability to the frame. Alternatively, the two or more support members can be vertical or slanted with respect to the ground in a tripod-like structure to provide stability to the frame.

What is claimed is:

1. An apparatus, comprising:

a frame having a first expanded configuration, a second expanded configuration and a collapsed configuration, the frame including a support member, a first elongate member, a second elongate member and a coupling member, the first elongate member having a first end portion and a second end portion opposite the first end portion, the first end portion of the first elongate member being pivotally coupled to the support member, the second elongate member having a first end portion and a second end portion opposite the first end portion, the first end portion of the second elongate member being pivotally coupled to the support member, the coupling member being coupled to the second end portion of the second elongate member and has a first location and a second location different from the first location, the coupling member defining a channel, the second end portion of the first elongate member being coupled to the coupling member at the first location of the coupling member when the frame is in its first expanded configuration, the second end portion of the first elongate member being coupled to the coupling member at the second location of the coupling member when the frame is in its second expanded configuration, at least a portion of the first elongate member being disposed in the channel defined by the coupling member when the frame is in at least one of its first expanded configuration or its second expanded configuration, the second end portion of the first elongate member being separated from the coupling member when the frame is in the collapsed configuration, at least a portion of the second elongate member being disposed in the channel defined by the coupling member when the frame is in the at least one of its first expanded configuration or its second expanded configuration.

2. The apparatus of claim 1, further comprising:

a hammock membrane coupled to the frame, the hammock membrane having a first end portion, a second end portion opposite the first end portion and a middle portion disposed between the first end portion and the second end portion, the first end portion defining a pocket configured to receive a torso portion of a user, the second end portion defining a pocket configured to receive a lower portion of the user, the pocket defined by the first end portion being separate from the pocket defined by the second end portion.

3. The apparatus of claim 1, wherein:

the support member has a first end portion and a second end portion opposite the first end portion, the first end portion of the second elongate member being pivotally coupled to the second end portion of the support member, the first end portion of the support member being disposed at a first distance orthogonal from a support surface when the frame is in its first expanded configuration, the first end portion of the support member being disposed at a second distance orthogonal from the support surface when the frame is in its second expanded configuration, the second distance being greater than the first distance.

4. The apparatus of claim 1, wherein the support member is a first support member, the first support member having a first end portion and a second end portion opposite the first end portion, the first end portion of the second elongate member being pivotally coupled to the second end portion of the support member, the apparatus further comprising:

a second support member having a first end portion and a second end portion opposite the first end portion; and a third elongate member having a first end portion and a second end portion opposite the first end portion, the first end portion of the third elongate member being pivotally coupled to the second end portion of the second support member, the first end portion of the first support member being at a first distance orthogonal from a support surface when then frame is in its first expanded configuration, the first end portion of the second support member being at a second distance orthogonal from the support surface when then frame is in its first expanded configuration, the first distance being substantially equal to the second distance.

5. The apparatus of claim 1, wherein the support member is a first support member, the first support member having a first end portion and a second end portion opposite the first end portion, the first end portion of the second elongate member being pivotally coupled to the second end portion of the support member, the apparatus further comprising:

a second support member having a first end portion and a second end portion opposite the first end portion; and a third elongate member having a first end portion and a second end portion opposite the first end portion, the first end portion of the third elongate member being pivotally coupled to the second end portion of the second support member, the first end portion of the first support member being at a first distance orthogonal from a support surface when then frame is in its second expanded configuration, the first end portion of the second support member being at a second distance orthogonal from the support surface when then frame is in its second expanded configuration, the first distance being greater than the second distance.

6. The apparatus of claim 1, wherein a first side portion of the coupling member defines a slot in communication with the channel.

7. The apparatus of claim 1, wherein a first end portion of the coupling member is movably coupled to a second end portion of the coupling member.

8. An apparatus, comprising:

a hammock membrane having a first end portion, a second end portion opposite the first end portion and a middle portion disposed between the first end portion and the second end portion, the first end portion defining a pocket configured to receive a torso portion of a user, the second end portion defining a pocket configured to receive a lower portion of the user, the pocket defined by the first end portion being separate from the pocket defined by the second end portion, an outer perimeter of the hammock membrane being constructed of a rigid material, at least one of the pocket defined by the first end portion or the pocket defined by the second end portion including a flexible material.

9. The apparatus of claim 8, wherein the pocket of the first end portion has a depth, the pocket of the second end portion has a depth, the depth of the first end portion being different than the depth of the second end portion.

10. The apparatus of claim 8, wherein a first portion of a perimeter of the pocket of the first end portion extends between the first end portion of the hammock membrane and the middle portion of the hammock membrane, the first portion of the perimeter of the pocket of the first end portion being directly coupled to the rigid material of the hammock membrane.

11. The apparatus of claim 8, wherein the pocket of the first end portion has a length and a first depth at a first location along the length of the pocket of the first end portion, and a second depth at a second location along the length of the pocket of the first end portion, the second location being different than the first location, the first depth being different than the second depth, a first portion of the hammock membrane being disposed between the first location of the pocket of the first end portion and the outer perimeter of the hammock membrane, a second portion of the hammock membrane being disposed between the second location of the pocket of the first end portion and the outer perimeter of the hammock membrane.

12. The apparatus of claim 8, further comprising:

an elongate member having a first end portion, a second end portion different from the first end portion, and a middle portion disposed between the first end portion and the second end portion of the elongate member, the first end portion of the elongate member being disposable in a first pocket coupled to an underside of the hammock membrane, the second end portion of the elongate member being disposable in a second pocket coupled to an underside of the hammock membrane, the middle portion of the elongate member being spaced apart from the hammock membrane when the first end portion of the elongate member is disposed in the first pocket and the second end portion of the elongate member is disposed in the second pocket.

13. The apparatus of claim 8, further comprising:

an elongate member having a first end portion and a second end portion opposite the first end portion, the first end portion of the elongate member being coupled to a first side portion of the middle portion of the hammock membrane, the second end portion of the elongate member being coupled to a second side portion of the middle portion of the hammock membrane.

14. The apparatus of claim 8, wherein the pocket defined by the first end portion of the hammock membrane is wedge-shaped, the pocket defined by the second end portion of the hammock membrane is wedge-shaped.

15. An apparatus, comprising:

a frame having a first expanded configuration, a second expanded configuration and a collapsed configuration, the frame having a first end portion and a second end portion opposite the first end portion, the frame configured to be supported on a support surface;

a rigid elongate member having a first end portion and a second end portion opposite the first end portion; and a hammock member having a first end portion, a second end portion opposite the first end portion, and a middle portion between the first end portion and the second end portion, the first end portion of the hammock member being removably coupled to the first end portion of the frame, the second end portion of the hammock member being removably coupled to the second end portion of the frame, the first end portion of the hammock member being separated from the support surface by a first distance orthogonal to the support surface when the frame is in its first expanded configuration and the frame is disposed on the support surface, the first end portion of the hammock member being separated from the support surface by a second distance orthogonal to the support surface when the frame is in its second expanded configuration and the frame is disposed on the support surface, the first distance being less than the second distance, the second end portion of the hammock member being separated from the support surface by a third distance orthogonal to the support surface when the frame is in its first expanded configuration and the frame is disposed on the support surface, the second end portion of the hammock member being separated from the support surface by a fourth distance orthogonal to the support surface when the frame is in its second expanded configuration and the frame is disposed on the support surface, the fourth distance being less than the third distance, the middle portion of the hammock member having a first side portion and a second side portion opposite the first side portion, the first side portion of the middle portion of the hammock member includes a first pocket configured to receive the first end portion of the rigid elongate member, the second side portion of the middle portion of the hammock member includes a second pocket configured to receive the second end portion of the rigid elongate member, the first end portion of the rigid elongate member being removably coupled to a hammock membrane of the hammock member at the first side portion of the middle portion of the hammock member and the second end portion of the rigid elongate member being removably coupled to the hammock membrane at the second side portion of the middle portion of the hammock member such that at least a portion of the rigid elongate member is disposed beneath the middle portion of the hammock member when the frame is supported on the support surface in at least one of its first expanded configuration or its second expanded configuration.

16. The apparatus of claim 15, wherein the third distance is substantially the same as the first distance.

17. The apparatus of claim 15, wherein the fourth distance is less than the second distance.

18. The apparatus of claim 15, wherein the hammock membrane includes a first material and a second material different than the first material, the first material is substantially flexible, the second material is substantially rigid, the second material of the hammock membrane is disposed about a perimeter of the first material of the hammock membrane.

19. The apparatus of claim 15, wherein the hammock membrane includes a first material and a second material different than the first material, the rigid elongate member including a third material different than the first material of the hammock membrane and different than the second material of the hammock membrane.

20. The apparatus of claim 15, wherein a portion of the elongate member between its first end portion and its second end portion does not contact the hammock member.

21. A hammock for supporting a user, comprising:

a hammock membrane having a first end portion, a second end portion opposite the first end portion and a middle portion between the first end portion and the second end portion, the hammock membrane having a first side portion and a second side portion opposite the first side portion, at least a portion of an outer perimeter of the hammock membrane being constructed of a rigid material;

a first elongate member having a first end portion and a second end portion opposite the first end portion, the first end portion of the first elongate member being coupled to the first end portion of the hammock membrane along the first side portion of the hammock membrane, the second end portion of the first elongate member being coupled to the first end portion of the hammock membrane along the second side portion of the hammock membrane;

a second elongate member having a first end portion and a second end portion opposite the first end portion, the first end portion of the second elongate member being coupled to the second end portion of the hammock membrane along the first side portion of the hammock membrane, the second end portion of the second elongate member being coupled to the second end portion of the hammock membrane along the second side portion of the hammock membrane; and a third elongate member having a first end portion and a second end portion opposite the first end portion, the first end portion of the third elongate member being coupled to the middle portion of the hammock membrane along the first side portion of the hammock membrane, the second end portion of the third elongate member being coupled to the middle portion of the hammock membrane along the second side portion of the hammock membrane, the third elongate member being configured to maintain the first side portion of the hammock membrane spaced apart from the second side portion of the hammock membrane.

22. The hammock of claim 21, wherein at least one of a middle portion of the first elongate member, a middle portion of the second elongate member, or a middle portion of the third elongate member is spaced apart from an underside of the hammock membrane.

23. The hammock of claim 21, wherein at least one of the first end portion of the first elongate member, the first end portion of the second elongate member, or the first end portion of the third elongate member is disposed in a first pocket coupled to the first side portion of the hammock membrane, at least one of the second end portion of the first elongate member, the second end portion of the second elongate member, or the second end portion of the third elongate member is disposed in a second pocket that is coupled to the second side portion of the hammock membrane.

24. The hammock of claim 22, wherein the first end portion of the hammock membrane has a length, a first depth at a first location along the length of the first end portion of the hammock membrane, and a second depth at a second location along the length of the first end portion of the hammock membrane, the second location being different than the first location, the first depth being different than the second depth.

25. The hammock of claim 21, wherein the third elongate member is constructed of a first material, the hammock membrane is constructed of at least a second material different than the first material.

26. The hammock of claim 21, wherein at least one of the first elongate member or the second elongate member is nonlinear between its first end portion and its second end portion.

* * * * *